US009184523B2

(12) United States Patent
Tamai

(10) Patent No.: US 9,184,523 B2
(45) Date of Patent: Nov. 10, 2015

(54) INTERMEDIATE ELECTRICAL CONNECTOR

(71) Applicant: Hirose Electric Co., Ltd., Tokyo (JP)

(72) Inventor: Nobuhiro Tamai, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 14/487,175

(22) Filed: Sep. 16, 2014

(65) Prior Publication Data

US 2015/0079814 A1 Mar. 19, 2015

(30) Foreign Application Priority Data

Sep. 17, 2013 (JP) ..... 2013-192128

(51) Int. Cl.

| | |
|---|---|
| ***H01R 29/00*** | (2006.01) |
| ***H01R 12/91*** | (2011.01) |
| ***H01R 13/518*** | (2006.01) |
| ***H01R 31/06*** | (2006.01) |
| *H01R 12/73* | (2011.01) |

(52) U.S. Cl.

CPC ..... *H01R 12/91* (2013.01); *H01R 13/518* (2013.01); *H01R 31/06* (2013.01); *H01R 12/73* (2013.01)

(58) Field of Classification Search

CPC ..... H01R 23/7068; H01R 27/00

USPC ..... 439/59, 218, 61, 502, 631

See application file for complete search history.

(56) References Cited

U.S. PATENT DOCUMENTS

| | | | | |
|---|---|---|---|---|
| 5,800,186 | A * | 9/1998 | Ramirez et al. | 439/74 |
| 7,862,376 | B2 * | 1/2011 | Sypolt et al. | 439/607.07 |
| 8,485,831 | B2 * | 7/2013 | Cipolla et al. | 439/74 |
| 2013/0164955 | A1 * | 6/2013 | Tamai | 439/76.1 |
| 2015/0079814 | A1 * | 3/2015 | Tamai | 439/55 |
| 2015/0079819 | A1 * | 3/2015 | Tamai | 439/101 |

FOREIGN PATENT DOCUMENTS

| | | |
|---|---|---|
| JP | 2009-070573 A | 4/2009 |

* cited by examiner

*Primary Examiner* — Phuongchi T Nguyen

(74) *Attorney, Agent, or Firm* — Kubotera & Associates, LLC

(57) ABSTRACT

An intermediate electrical connector is to be connected to a mating connecting member. The intermediate electrical connector includes an intermediate connecting member; a blade disposed in the intermediate connecting member; and a supporting member for supporting the intermediate connecting member. The intermediate connecting member includes a supported portion disposed on a side surface portion thereof and supported on the supporting member. The supporting member is formed of a plate member facing the side surface portion of the intermediate connecting member. The supporting member includes a supporting portion accommodated in the supported portion or receiving the supported portion with a space in between.

8 Claims, 23 Drawing Sheets

INTERMEDIATE ELECTRICAL CONNECTOR

BACKGROUND OF THE INVENTION AND RELATED ART STATEMENT

The present invention relates to an intermediate electrical connector for connecting two mating connectors, with the mating connecting bodies are mating connectors or circuit boards.

As a conventional connector of this type, there is known an intermediate electrical connector that is an intermediate electrical connector disclosed in Patent Reference. Patent Reference discloses an electrical connector assembled component, in which electrical connectors for circuit board use (mating connectors), the mating connecting bodies, are fitted to the intermediate electrical connector from thereabove and from thereunder. As a result, an electrical connector assembled component is completed, and the upper and lower mating connectors are electrically connected via the intermediate electrical connector. The conventional intermediate electrical connector includes a plurality of intermediate members and a housing. The plurality of intermediate members has flat shape and is to be connected to the respective mating connecting bodies. The housing arranges and holds the plurality of intermediate members in the sheet thickness direction of the intermediate members.

Patent Reference: Japanese Patent Application Publication No. 2009-070573

Each intermediate member has a plurality of terminals on one surface of a substrate that is flat and is made of electrically insulating material, and has a shielding plate on the other surface. Each terminal is formed of thin strip-like member extending in the up-and-down direction. Each terminal has a contact sections at an upper end thereof and at a lower end thereof, to contact with mating terminals provided in the mating connector(s). The housing is made of an electrically insulating material as one member. The housing has slit-like housing groove portions to house the respective intermediate members, penetrating in the up-and-down direction and being arranged in the arrangement direction of the intermediate members (in a longitudinal direction of the housing). The groove portion width of each housing groove portion (dimension of an inner width thereof in the arrangement direction) is formed slightly larger than the thickness of the intermediate members.

When the intermediate members are housed in the housing groove portions, there are gaps formed in the arrangement direction between sheet surfaces of the intermediate members and the inner wall surfaces of the housing groove portions. Moreover, the upper-end parts and lower-end parts of the intermediate members protrude from upper-end openings and lower-end openings of the housing groove portions.

The two mating connectors are formed to have the same shape. The two mating connectors are configured such that the slit-like receiving groove portions receive the upper-end parts and the lower-end parts of the intermediate members. The slit-like receiving groove portions are arranged and formed in the longitudinal direction of the housing (mating housing) of each mating connector. In the respective receiving groove portions, there is arranged a plurality of mating terminals in a lateral direction of the mating housing (a connector's widthwise direction that is perpendicular to the longitudinal direction). The plurality of mating terminals corresponds to the terminals of the intermediate members. The contact sections of the mating terminals protrude towards inside of the receiving groove portions in the groove portion's widthwise direction (the longitudinal direction).

Moreover, the groove portion width of the receiving groove portions is made slightly larger than the thickness of the intermediate members. When the upper end parts and the lower end parts are inserted in the receiving groove portions, there are formed gaps between sheet surfaces of the intermediate members and the receiving groove portions. On the both surfaces of the dividing walls that divide between the receiving groove portions, there is formed a plurality of protruding portions at the same height level as the contact sections of the mating terminals. In a state that the connectors are fitted, the upper end parts and the lower end parts of the intermediate members inserted in the receiving groove portions of the respective mating connectors are restricted at the both sheet surfaces from movement in the groove portion's widthwise direction, by the plurality of protruding portions.

According to Patent Reference, when the intermediate electrical connector fits to the mating connector in a state of being displaced in the arrangement direction, or when the intermediate connector fits to the mating connector at a normal position, but the positions are displaced after the fitting by receiving external force in the arrangement direction, the intermediate connector tilts around the protruding portions having the protruding portion as a fulcrum so as to be able to follow the displacement between the mating connectors. As a result, it is possible to maintain the connected state of the connectors.

According to the connector assembled component of Patent Reference, when the displacement in the longitudinal direction occurs between the intermediate electrical connector and the mating connector, the intermediate members of the intermediate electrical connector tilts using the gap in the housing groove portion so as to follow the displacement. The tilting of the intermediate members is allowed in the range of the groove portion width of the housing groove portions. Therefore, in order to handle large displacement that occurs within expectation, it is necessary to secure sufficiently large groove portion width of the housing groove portions. In addition, in order to maintain the strength of the housing, it is necessary to secure the thickness of the end walls of the housing and the dividing walls between the housing groove portions. Those necessities increases will cause size increase of the intermediate electrical connector and in turn the connector assembled body in the longitudinal direction.

Furthermore, as described in Patent Reference, it is not easy to form in the housing or in the mating housing the housing groove portions or the receiving groove portions in a large number being close to each other.

In view of the above-described issues of conventional technique, there is provided an invention, an object of which is to provide an intermediate electrical connector that can keep up with the physical displacement of the mating connecting bodies relative to each other without increasing the size of the connector and that can be easily produced.

Further objects and advantages of the present invention will be apparent from the following description of the present invention.

SUMMARY OF THE PRESENT INVENTION

In order to attain the objects describe above, according to a first aspect of the invention, an intermediate electrical connector includes a plurality of intermediate connecting members and supporting members. Each connecting body includes a blade, which includes a substrate. Each substrate includes a plurality of terminals provided thereon.

The plurality of terminals extend between an upper end side and a lower end side of the substrate and have contact sections at their upper ends and have connecting sections at their lower ends, respectively. The plurality of intermediate connecting members is arranged and supported together by the supporting members. The intermediate connecting members connect at their upper ends and the lower ends to mating connecting bodies, which are a mating connector(s) or circuit board(s).

According to the first aspect of the invention, in the intermediate electrical connector, each intermediate connecting member includes supported portions on its both side surfaces of the intermediate connecting member. The supporting members are made of a plate member.

The plate member extends in the arrangement direction of the intermediate connecting members and in the up-and-down direction. The plate member has sheet surfaces respectively face to both side surfaces of the intermediate connecting member over the arrangement range of the intermediate connecting members in the arrangement direction. The supporting members house the supported portions or are housed in the supported portions at positions in the arrangement direction, which correspond to the supported portions of the respective connecting bodies. The supporting members have supporting members to support the supported portions in the arrangement direction, while having gaps from the supported portions in the arrangement direction.

According to the first aspect of the invention, the intermediate connecting members are not housed to be supported in the slit-like housing groove portions formed in the housings as it is conventional. Instead, the relay electrical connecting bodies are supported by the flat supporting members at both side surfaces of the intermediate connecting members. Therefore, it is not necessary to provide a dividing wall of the housing between the intermediate connecting members, so that it is possible to dispose the intermediate connecting members close to each other. Therefore, it is possible to reduce the size of the intermediate electrical connector in the arrangement direction. Moreover, it is also not necessary to provide the end walls of the housings outside the arrangement range of the intermediate connecting members. Therefore, it is possible to further reduce the size of the intermediate electrical connector.

Furthermore, according to the first aspect of the invention, the supporting members are flat members. Therefore, it is not necessary to form the housing groove portions or receiving groove portions, widths of which are not so large, in a large number or very closely to each other. In addition, it is also not necessary to form protruding portions in the receiving groove portions. Therefore, the supporting members do not have a complicated shape. Accordingly, it is easy to produce the supporting members. Moreover, when the supporting members are made of a sheet metal piece, it is possible to use the supporting members as shielding plates.

According to a second aspect of the invention, in addition to the blade(s), each intermediate connecting member includes a blade holding member for holding and housing the blade. Each supporting member includes an upper supporting member formed on an upper edge of the supporting member and a lower supporting member formed at a lower edge of the supporting member. Each supported portion can include an upper supported portion and a lower supported portion on the both side surfaces of the blade holding member. The upper supported portion houses the upper supporting member and is supported by the upper supporting member. The lower supported portion houses the lower supporting member and is supported by the lower supporting member.

As described above, the upper supporting members and the lower supporting members of the supporting members are housed in the upper supported portions and the lower supported portions of the blade holding bodies and support the blade holding bodies. In this state, if the displacement in the arrangement direction occurs between the mating connecting bodies, the upper and the lower supported portions tilt within the gaps from the upper and the lower supporting members. Following the displacement, the intermediate connecting members tilt.

According to a third aspect of the invention, each intermediate connecting member includes protruding portions, which protrude outward in the connector's width direction that is perpendicular to side surfaces of the relay connector in the middle in the up-and-down direction. While those protruding portions contact by pressure to sheet surfaces of the supporting members, the upper supporting members and the lower supporting members can energize inner wall surfaces of the upper supported portions and the lower supported portions outward in the connector's width direction.

As described above, the supporting members energize the blade holding bodies outward in the connector's widthwise direction, and thereby backlash in the connector's widthwise direction will not occur between the respective blade holding bodies and the supporting members. Therefore, it is possible to keep the blade holding bodies at normal positions in the connector's widthwise direction. As a result, it is easier to connect the intermediate electrical connector to the mating holding bodies.

In addition, for example, it is also possible to provide grounding plates to the respective blades and form the protruding portions as a part of each grounding plate and make the supporting members from the sheet metal piece. In this case, it is possible to use the supporting members as shielding plates. In addition, since the protruding portions contact by pressure with the sheet surfaces of the supporting members, the protruding portions and the supporting members are electrically connected to each other. Therefore, it is possible to improve the grounding effect.

According to a fourth aspect of the invention, each intermediate connecting member includes supported portions, which protrude from the both side end surfaces of the substrate. The supported portions are supported by the supporting members. The supporting members extend in the arrangement direction and the up-and-down direction of the intermediate connecting members. The supported portions are made of a plate member having sheet surfaces that face the respective side end surfaces of the intermediate connecting members over the arrangement range of the intermediate connecting members in the arrangement direction. Each supporting member is split along the up-and-down direction and includes an upper member and a lower member.

The upper member faces an upper area of the side end surfaces of the intermediate connecting members. The lower member faces the lower area thereof and can move in the arrangement direction in a specified range in the arrangement direction relative to the upper member. The upper members and the lower members of the supporting members can have supporting members formed so as to correspond to the supported portions of the respective intermediate connecting members. With those supporting members, the upper members and the lower members can house and support the supported portions, while having gaps from the supported portions.

When the displacement occurs between the mating connecting bodies in the arrangement direction, the supported portions of the intermediate connecting members tilt within the gaps from the supporting members of the supporting members. As a result, the intermediate connecting members are also in a tilted state following the displacement. Moreover, according to the fourth aspect of the invention, the supporting members to support the respective intermediate connecting members are split into the upper members and the lower members. The respective upper members and lower members can move within specified ranges in the arrangement direction of the intermediate connecting members.

Therefore, in comparison with a case of supporting the intermediate connecting members with supporting members that are respectively made as one member, it is possible to secure a large space in the arrangement direction. The large space allows the supported portions of the intermediate connecting members to tilt in the supporting members, for the amount of the relative movable range between the upper members and the lower members. As a result, the intermediate connecting members can tilt at large angles, and thereby can keep up with the large displacement in the arrangement direction.

According to a fifth aspect of the invention, the supported portions of the intermediate connecting members protrude from the both side end surfaces of the intermediate connecting members and have sheet surfaces perpendicular to the arrangement direction. Each supporting member includes the upper member and the lower member, which respectively include supporting members. The supporting members can be formed as slit-like groove portions that extend and opened downward and upward, respectively. The supporting members have edge sections that extend in the up-and-down direction and form the supporting members. On those edge sections, there may be formed support protruding portions that protrude towards inside of the groove portions. The support protruding portions support the supported portions of the intermediate connecting members.

As described above, the support protruding portions, which protrude towards inside of the groove portions, support the supported portions of the intermediate connecting members. When the displacement between the mating connectors occur in the arrangement direction, the intermediate connecting members tilt around the support protruding portions, while the support protruding portions stably support the supported portions. Accordingly, in this case, the intermediate connecting members are in a tilted state to catch up with the displacement.

According to a sixth aspect of the invention, the supporting members are disposed such that the edges of the upper member and the lower member, which face each other, engage each other. Their edges have regulating portions for keeping relative movements of the upper members and the lower members within specified range. The regulating portions are provided in pairs at the same positions in the arrangement direction. The regulating portions provided on one member, the upper members or the lower members, have regulating recessed portions, which are recessed. The regulating portions provided on the other member, the lower members or the upper members, have regulating protruding portions, which protrude from the members. The regulating protruding portions are provided to engage with the regulating recessed portions within the regulating recessed portions. Outer edges of the regulating protruding portions abut inner edges of the regulating recessed portions in the arrangement direction, it is possible to restrict the relative movement between the upper members and the lower members, which exceeds the allowable range.

Furthermore, the regulating recessed portions and the regulating protruding portions are provided using the range that overlaps each other in the up-and-down direction. Therefore, even if when the dimensions of the regulating recessed portions and the regulating protruding portions are increased in the up-and-down direction, the sizes of the supporting members and in turn the intermediate electrical connector will not increase so much. Moreover, increasing the dimensions of the regulating recessed portions and the regulating protruding portions in the up-and-down direction, the area, where the regulating recessed portions and the regulating protruding portions abut each other, increases, so that it is possible to secure sufficient restricting strength.

According to a seventh aspect of the invention, in each intermediate connecting member, the substrate has a plurality of terminals as well as grounding plates. A side end section of each grounding plate can protrude from the both sides of the substrate, and form the supported portions. Providing the supported portions on the grounding plates, the supporting members of the supporting members support the supported portions. Moreover, the grounding plates are made of a sheet metal piece. Therefore, when the supporting members are also made from a sheet metal piece, it is possible to use the supporting members as shielding plates. In addition, supporting the supported portions of the grounding plates by the supporting members of the supporting members, it is possible to enhance the grounding effect.

According to an eighth aspect of the invention, the supporting members are made by punching sheet metal while keeping the flat surfaces thereof. The upper members and the lower members of the supporting members are formed to have the same shape but being turned upside down. The supporting members, the regulating recessed portions, and the regulating protruding portions can be formed so as to repeat a specific order and at specific intervals in the arrangement of the intermediate connecting members.

According to a eighth aspect of the invention, the above-described supporting members, regulating recessed portions, and regulating protruding portions are formed from a sheet metal piece. Then, cutting the sheet metal piece into a suitable length (a dimension in the arrangement direction) for the number of the intermediate connecting members, the supporting members are obtained. Therefore, even if the number of the intermediate connecting members or the intervals between the intermediate connecting members increase, it is possible to make the supporting members of desired length from one type of sheet metal piece by cutting the sheet metal piece according to the number of or the intervals between the intermediate connecting members.

As a result, it is possible to restrain the manufacturing cost. Moreover, since the upper members and the lower members have the identical shape, so that it is possible to make the both upper members and lower members from one type of sheet metal piece. As a result, it is possible to further restrain the manufacturing cost. Furthermore, the supporting members are made from a sheet metal piece having sheet surfaces that face the both side end surfaces of the intermediate connecting members, and it is easier to process than a case of making the supporting members having housing groove portions to house the intermediate connecting members from an electrically insulating material or the like. As a result, it is possible to easily make the supporting members.

As described above, according to the invention, the supporting members support the intermediate connecting members. The supporting members are made of plate member having sheet surfaces that respectively face the both side surfaces of the intermediate connecting members. Therefore, there is no dividing wall provided between the intermediate connecting members that are adjacent to each other.

In addition, there is no end wall outside the arrangement range of the intermediate connecting members in the arrangement direction of the intermediate connecting members. As a result, it is possible to reduce the size of the intermediate electrical connector in the arrangement direction. Furthermore, the supporting members are flat members and do not have complicated shape. Therefore, it is easy to produce the supporting members.

BRIEF DESCRIPTION OF THE DRAWINGS

FIGS. 3(A) and 3(B) are perspective views showing a intermediate connecting member, wherein FIG. 3(A) shows the intermediate connecting member in a finished state and FIG. 3(B) shows the intermediate connecting member a state that members thereof are separated from each other;

FIGS. 4(A) and 4(B) are perspective views showing a blade, wherein FIG. 4(A) shows the blade viewed from a side of an inner grounding plate and FIG. 4(B) shows the blade viewed from a side of an outer grounding plate;

FIGS. 7(A) and 7(B) are sectional views showing the intermediate connecting member, taken at surfaces perpendicular to a blade's widthwise direction, wherein FIG. 7(A) is the sectional view taken at the surface where grounding terminals are present and FIG. 7(B) is the sectional view taken at the surface where signal terminals are present;

FIGS. 8(A), 8(B), and 8(C) are perspective views showing a step of arranging terminals in manufacturing a blade, wherein FIG. 8(A) shows one terminal group, FIG. 8(B) shows the other terminal group, and FIG. 8(C) shows a state that the one terminal group and the other terminal group are put together;

FIGS. 11(A) and 11(B) are sectional views showing the intermediate electrical connector, taken at a surface perpendicular to the blade's widthwise direction, more specifically which is taken at a sheet surface of a support member, wherein FIG. 11(A) shows the intermediate electrical connector in a normal state, and FIG. 11 (B) shows a section showing the intermediate electrical connector in a floating state;

FIGS. 13(A), 13(B), and 13(C) are perspective views of mating grounding plates, wherein FIG. 13(A) is a perspective view showing one mating grounding plate, FIG. 13(B) is a perspective view of the other mating grounding plate, and FIG. 13(C) is a perspective view showing the one and the other mating grounding plates with a plurality of mating terminals thereof;

FIGS. 14(A), 14(B), and 14(C) are sectional views showing the mating connector, wherein FIG. 14(A) is a sectional view showing the mating connector taken at a surface perpendicular to the up-and-down direction, FIG. 14(B) is a sectional view showing the mating connector, taken at a surface perpendicular to the terminals' arrangement direction, more specifically which is taken at the mating grounding terminals, and FIG. 14(C) is a sectional view showing the mating connector taken at a surface perpendicular to the terminals' arrangement direction, more specifically which is taken at mating signal terminals;

FIGS. 19(A), 19(B), and 19(C) are views of one intermediate connecting member, wherein FIG. 19(A) is a perspective view thereof, FIG. 19(B) is a side view thereof, and 19(C) is a bottom view thereof;

FIGS. 20(A) and 20(B) are views showing the steps of assembling the intermediate electrical connector, wherein FIG. 20(A) is a perspective view showing the step of attaching the intermediate connecting members to lower members of the support members, and FIG. 20(B) is a side view showing a state of the intermediate connecting members attached to the lower support members;

FIGS. 21(A) and 21(B) are views showing the steps of assembling the intermediate electrical connector, wherein FIG. 21(A) is a perspective view showing the step of attaching upper members to the intermediate connecting member attached to the lower member, and FIG. 21(B) is a side view showing a state of the upper member attached to the intermediate connecting members;

DETAILED DESCRIPTION OF THE PREFERRED EMBODIMENTS

Hereunder, an embodiment of the present invention will be described with reference to the accompanying drawings.

First Embodiment

Figure 1:
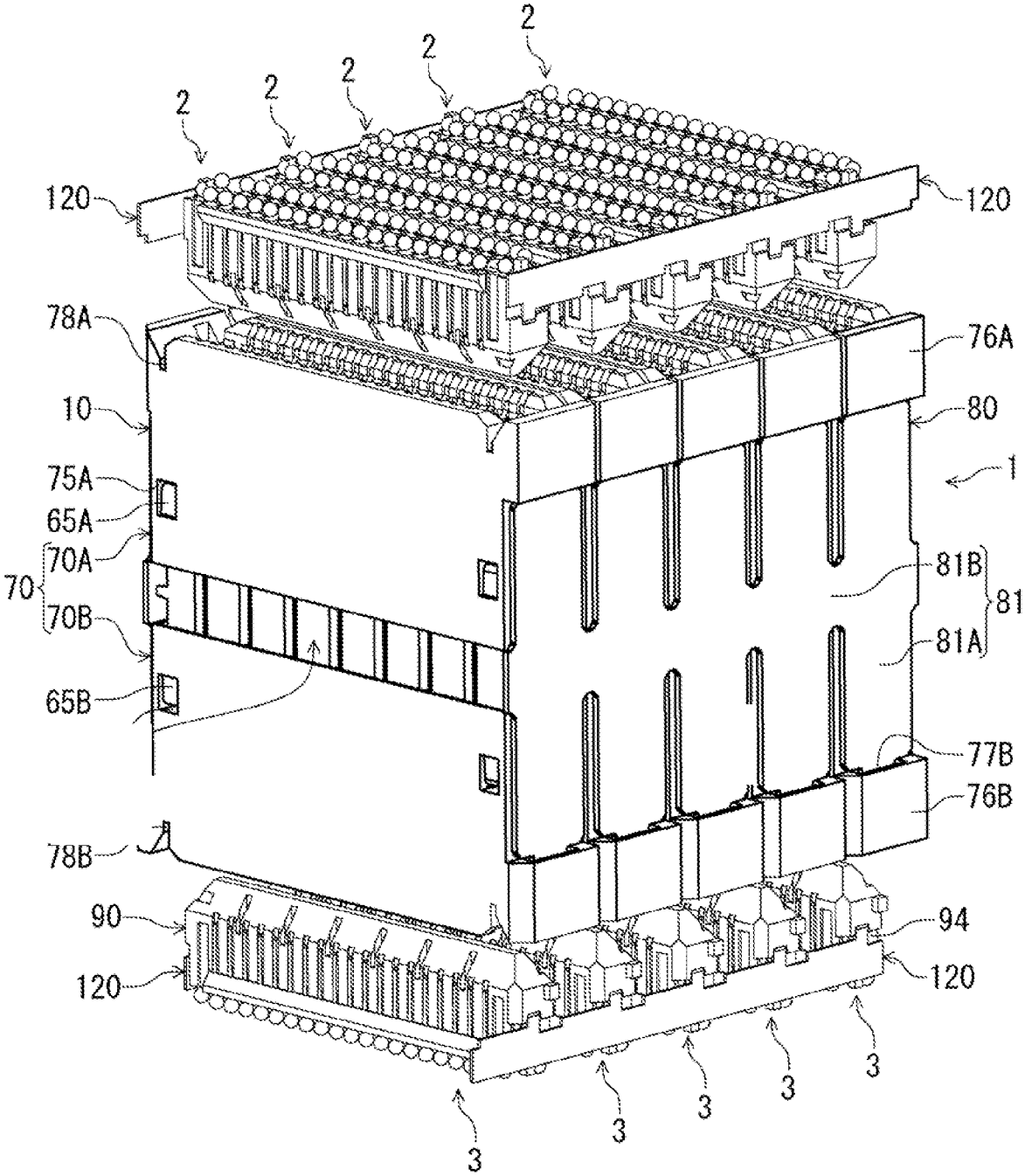
FIG. 1 is a perspective view showing an intermediate electrical connector according to a first embodiment of the invention, which is shown with mating connectors thereof before fitting to the intermediate electrical connector.
Figure 2:
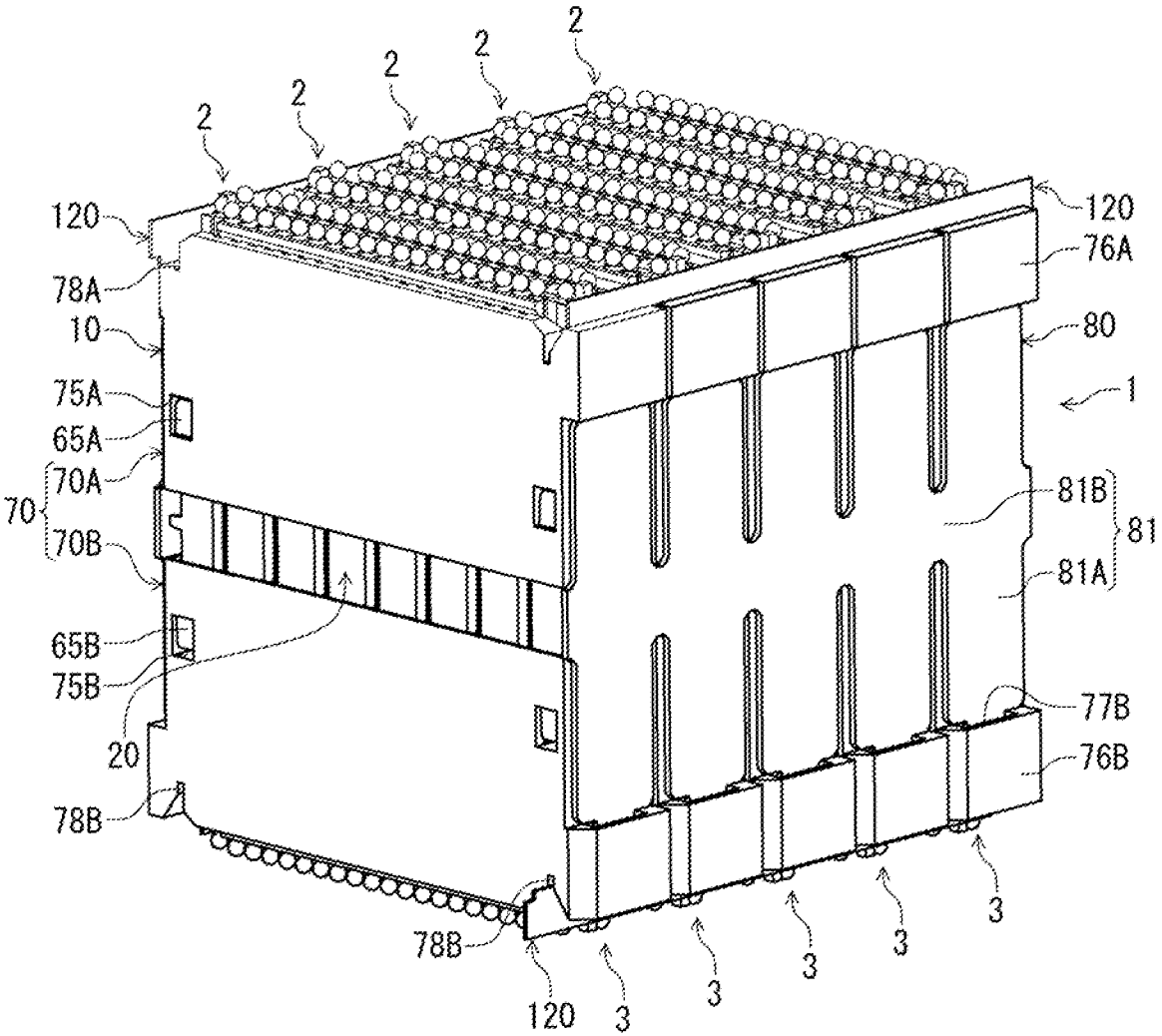
FIG. 2 is a perspective view showing the intermediate electrical connector of FIG. 1, which is shown with the mating connectors thereof in a state that the mating connectors are fitted to the intermediate electrical connector.

A first embodiment of the present invention will be explained. FIG. 1 is a perspective view showing an intermediate electrical connector according to the first embodiment of the invention, which shows with mating connectors thereof, in a state before fitting to the intermediate electrical connector. FIG. 2 is a perspective view showing the intermediate electrical connector of FIG. 1 and the mating connectors thereof in their fitted states.

As shown in FIG. 1, to the intermediate electrical connector 1 of the embodiment (hereinafter simply referred to as "relay connector 1"), connected are mating connecting bodies, mating connectors 2 and 3, from thereabove and thereunder, respectively. The intermediate electrical connector relays and connects between the mating connectors 2 and 3. The mating connectors 2 and 3 are electrical connectors to be used on circuit boards, have the same shapes, and are to be connected to circuit boards (not illustrated) that are different from each other.

In the first embodiment, as shown in FIG. 1, five mating connectors 2 disposed on one circuit board and five mating connectors 3 disposed on another circuit board are connected via the relay connector 1 having five intermediate connecting members. As for the intermediate connecting members, explanation will be provided below.

The relay connector 1 shown in FIG. 1 includes a plurality of intermediate connecting members and two support members. The plurality of intermediate connecting members is to be connected to the mating connectors 2 and 3. The two support members are made of sheet metal, arrange the plurality of intermediate connecting members 10 and support them together. According to the embodiment, there are provided five intermediate connecting members are provided, so as to respectively correspond to the plurality of mating connectors 2 and 3. Those five intermediate connecting members 10 are arranged at equal intervals being close to each other in one direction horizontal to surfaces of the circuit boards.

Figure 3:
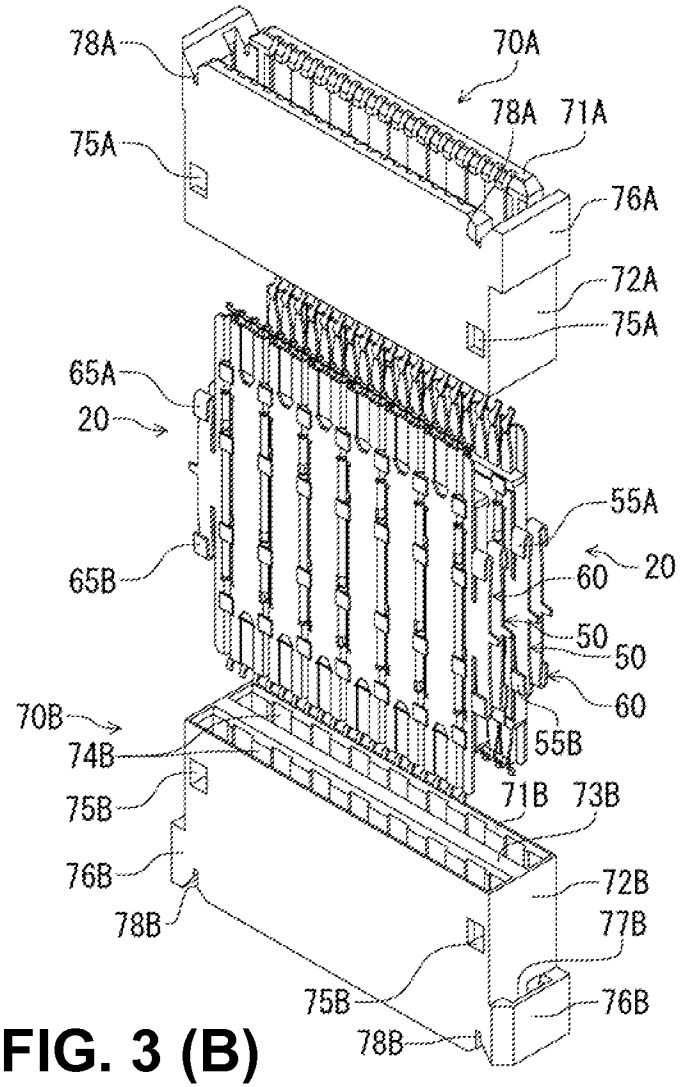
Figure 3:
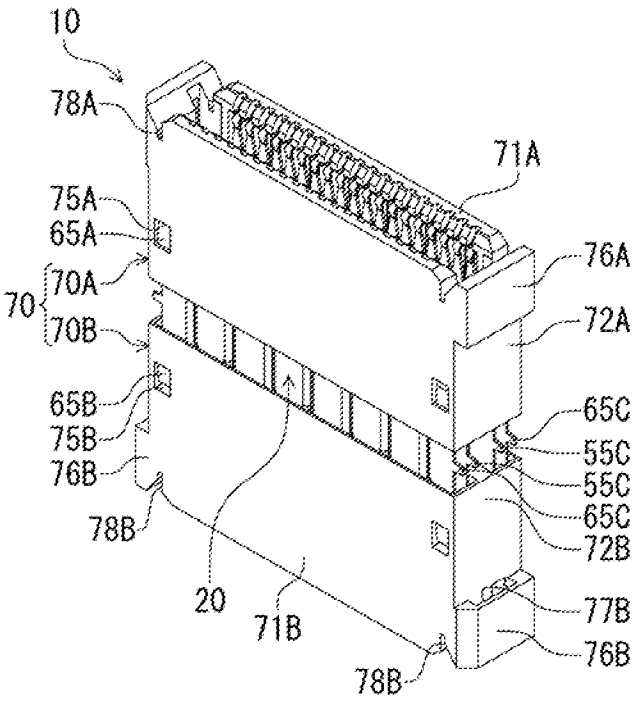

As shown in FIG. 3(B), each intermediate connecting member 10 has the same shape, and includes two blades 20. The two blades 20 face each other in a pair, being symmetrical about an arrangement direction of the intermediate connecting members 10. Each pair of the blades is held in and by the blade holding bodies 70, which will be described later (See also FIGS. 6, 7(A), and 7(B)). The space opened upward between the blades 20 in an upper part of the intermediate connecting member 10 is formed as an upper receiving section 11 (See FIGS. 7(A) and 7(B)) for receiving a fitting wall section 92 of the mating connector, which will be described later. On the other hand, the space opened downward between the blades 20 in an lower part of the intermediate connecting member 10 works as a lower receiving section 12 (See FIGS. 7(A) and 7(B)) for receiving a fitting wall section 92 of the mating connector 3, which will be described later.

Figure 7:
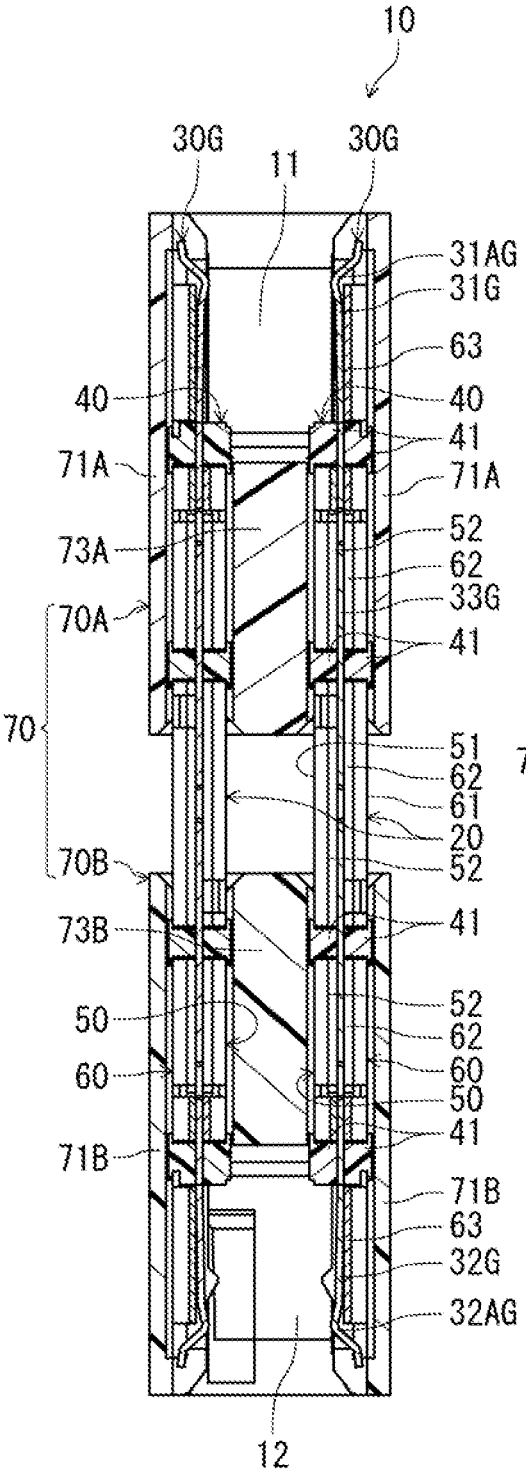
Figure 7:
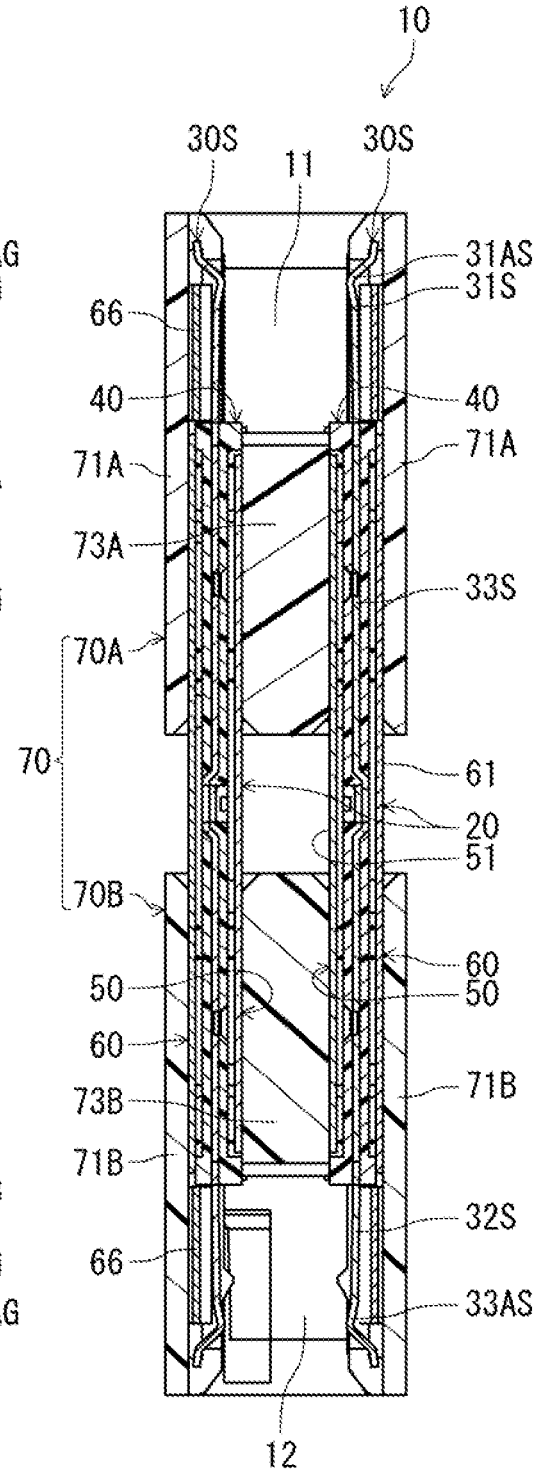

As shown in FIGS. 4(A) and 4(B), each blade 20 includes a plurality of terminals 30, a substrate 40, a first grounding plate 50, and a second grounding plate 60 (See also FIGS. 7(A) and 7(B)). The plurality of terminals 30 is arranged at equal intervals in a connector's widthwise direction (identical to a widthwise direction of the blade), which is perpendicular to the arrangement direction of the intermediate connecting members 10. The substrate 40 is made of resin and holds the plurality of terminals 30 being integrally molded therewith.

The first grounding plate 50 is attached on a side of one sheet surface of the substrate 40 ("first" herein corresponds to "inner-side", which will be described later). The second grounding plate 60 ("second" herein corresponds to "outer-side", which will be described later) is attached on a side of the other sheet surface. Hereinafter, in a pair of two blades 20, a side where surfaces thereof face each other is referred to as "inner side", and an opposite side thereof is referred to as "outer side". In addition, the first grounding plates 50 provided on the inner side of the blade 20 will be referred to as "inner grounding plate 50", and the second grounding plates provided on the outer side of the blade 20 will be referred to as "outer grounding plate 60".

As shown in FIG. 4(A), the plurality of terminals 30 includes signal terminals 30S and grounding terminals 30G. In each blade 20, the terminals 30 are arranged so as to have each grounding terminal 30G disposed between two signal terminals 30S that are adjacent to each other (See also 8(C)). According to the embodiment, the two adjacent signal terminals 30S transmit high-speed differential signals that are paired to each other. Hereunder, when it is not necessary to specially distinguish between the signal terminals 30S and the grounding terminals 30G, those terminals are comprehensively referred to as "terminals 30".

Each terminal is made by partially bending a strip-like metal piece that extends in a connector's fitting direction, i.e., in an up-and-down direction. Each terminal 30 includes an upper elastic arm 31 that extends upward from an upper end of the substrate 40, a lower elastic arm 32 extending downward from a lower end of the substrate 40, and a joining section 33 that extends in the up-and-down direction and joins between the upper elastic arm 31 and the lower elastic arm 32 (See FIGS. 7(A), 7(B), and 8(C)). Hereunder, in the respective parts of the terminals 30, when it is necessary to distinguish between the signal terminals 30S and the grounding terminals 30G, those parts will be described affixing "S" or "G" to the respective reference numerals.

The upper elastic arms 31 and the lower elastic arms 32 can elastically displace in their respective sheet thickness directions. On an upper end side of the upper elastic arms 31 and lower end side of the lower elastic arms 32, there are formed upper contact sections 31A and lower contact sections 32A, respectively. The upper and lower contact sections 31A and 32A are bent so as to protrude inward (towards a side where the two blades face each other) in the sheet thickness direction. The upper contact sections 31A and the lower contact sections 32A elastically contact with terminals 100 of the mating connectors 2 and 3 ("mating terminals 100", which will be described later).

Figure 8:
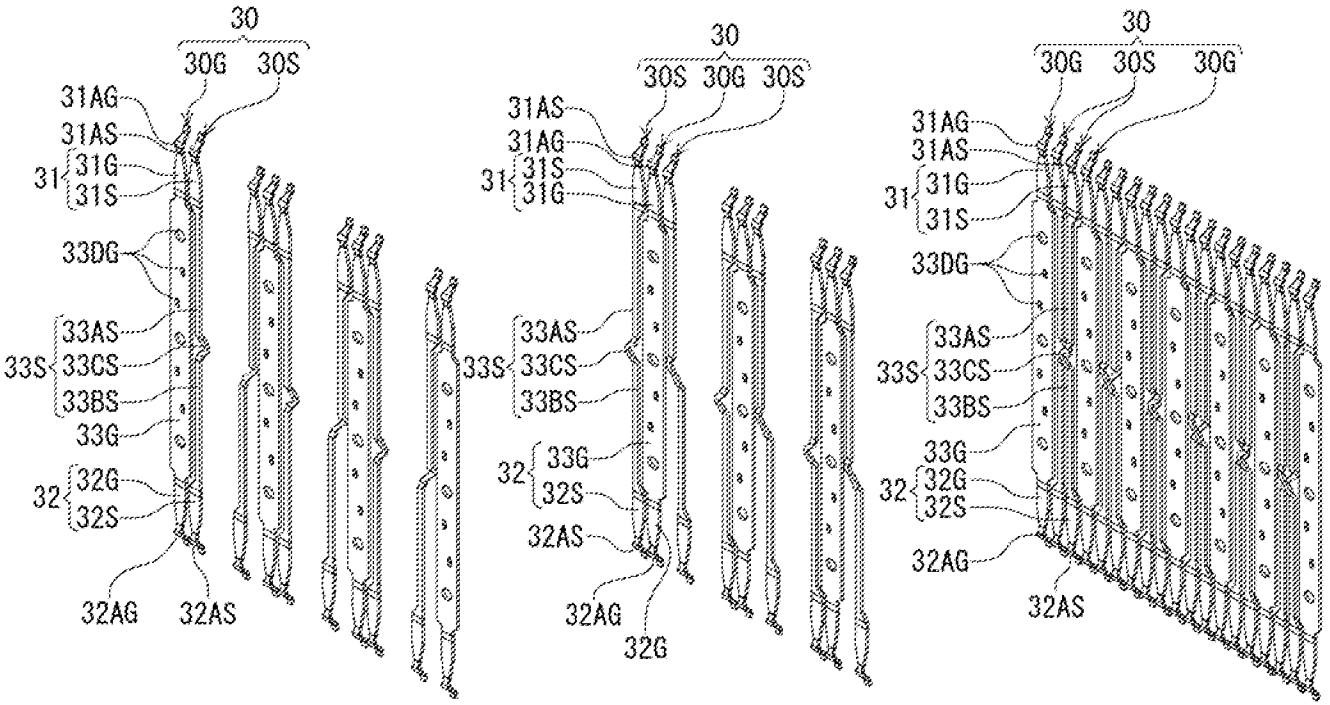

As shown in FIGS. 7(A), 7(B), and 8(C), the joining sections 33 join the upper elastic arms 31 and the lower elastic arms 32, and thereby indirectly join between the upper contact sections 31A and the lower contact sections 32A. As shown in FIG. 8(C), a joining section 33S of each signal terminal 30S includes an upper joining section 33AS, a lower joining section 33BS, and a center joining section 33CS. The upper joining section 33AS extends straight over generally upper half part of the joining section 33S. The lower joining section 33BS extends straight over a lower half part of the joining section 33S. The center joining section 33CS is a bent section provided at a center part of the joining section 33S in an up-and-down direction thereof. The center joining section 33CS joins between the upper joining section 33AS and the lower joining section 33BS. The signal terminals 30S that are adjacent to each other are paired and there is provided a plurality of such pairs. The plurality of such pairs includes cross pairs and straight pairs.

In each cross pair, the center joining sections 33CS cross each other at a center part thereof in the up-and-down direction. In each straight pair, the center joining sections 33CS are bent at their center parts so as to be close to each other. In each straight pair, the center joining sections 33CS look as if cross each other when viewed in the sheet's thickness direction of the signal terminals 30S. The cross pairs and the straight pairs are alternately disposed having a grounding terminal therebetween in the terminals' arrangement direction, thereby reducing cross talks between adjacent pairs. Each pair's shape is well known, so that detailed description is omitted.

As shown in FIG. 8(C), a joining section 33G of each grounding terminal 30G is formed to be wider than the joining section of each signal terminal 30S. Each joining section 33G extends straight as a whole. Each joining section 33G includes through holes 33DG, which are provided in a plurality in the up-and-down direction and penetrate in the sheet's thickness direction. As will be described later, into the through holes 33DG, protruding portions 52A and 62A of the grounding plates 50 and 60 are fitted. With this configuration, the inner grounding plate 50 and the outer grounding plate 60 can contact each other and in turn electrically connect to each other.

Figure 5:
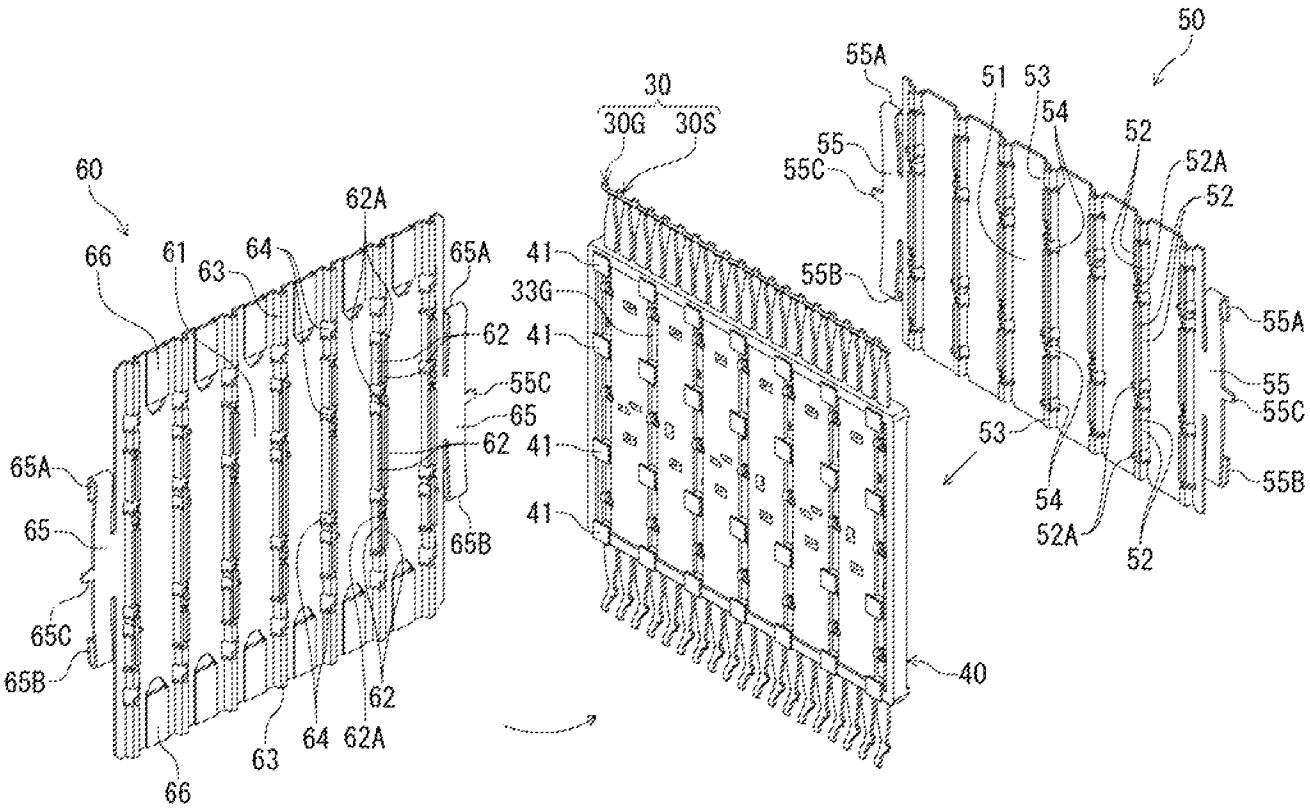
FIG. 5 is a perspective view showing a state that the inner grounding plate and the outer grounding plate are detached from the blade.

As shown in FIG. 5, the substrate 40 extends over a range that includes the arrangement range of the terminals 30 in the terminal arrangement direction (blade's widthwise direction). The substrate 40 has a quadrilateral shape extending over the range of the joining section 33 in the up-and-down direction (See also FIGS. 7(A) and 7(B)). On the both sheet surfaces of the substrate 40 (surfaces perpendicular to the sheet thickness direction of the substrate 40), corresponding to the grounding terminal 30G in the terminal arrangement direction, there are formed holding protruding portions 41 for holding the grounding plates 50 and 60 at an upper end, a lower end, and two middle positions between the upper end and the lower end.

The holding protruding portions 41 protrude from the sheet surfaces of the substrate 40 (See also FIGS. 4(A) and 4(B)). Moreover, corresponding to the grounding terminals 30G, in area other than the plurality of holding protruding portions 41 in the up-and-down direction, the sheet surfaces of the joining sections 33G of the grounding terminals 30G are exposed. Here, the holding protruding portions 41 shown in FIG. 5 have quadrilateral shapes when viewed in the sheet's thickness direction of the substrate 40. However, the holding protruding portions 41 are formed in the shapes when the holding protruding portions 41 are melted and are deformed upon attaching the grounding plates 50 and 60 to the substrate 40 by ultrasonic welding (See also FIGS. 4(A) and 4(B)). Before the ultrasonic welding, the holding protruding portions 41 have shapes of cylindrical protruding portions.

As described above, the inner grounding plates 50 are provided on surfaces of the substrates 40 that face each other inward in the intermediate connecting member 10, i.e., a side of surfaces of the terminals 30 where the contact sections 31A and 32A are provided. That is, the inner grounding plates 50 are provided on a side of protruding surfaces of the terminals 30 (See FIG. 4(A)). The inner grounding plate 50 is made of a sheet metal piece, and formed by bending work and press work. Each inner grounding plate 50 includes an inner grounding main body 51 having a quadrilateral shape, and projecting side sections 55. The projecting side sections 55 are provided in the middle of the inner grounding main body 51 in the up-and-down direction on both outer sides of the inner grounding main body 51 in the terminals' arrangement direction (blade's widthwise direction).

The inner grounding main body 51 has generally the same dimension as the substrate 40 in the terminals' arrangement direction and extends over the range of the terminal arrangement. In the up-and-down direction, the inner grounding main body 51 extends over the range where the joining sections 33 are present in the up-and-down direction (See FIGS. 7(A) and 7(B)).

Moreover, as shown in FIG. 5, the inner grounding main body 51 has inner protruding thin contact sections 52 within the range corresponding to exposed surfaces of the joining sections 33G of the grounding terminals 30G from the substrate 40. The inner protruding thin contact sections 52 are bent towards the exposed surfaces in the sheet thickness direction of the inner grounding main body 51, and extend in the up-and-down direction (See also FIG. 6).

As shown in FIG. 5, the inner protruding thin contact sections 52 are formed by cutting and lifting a part of the inner grounding main body 51 corresponding to the ranges of surfaces to expose. The inner protruding thin contact sections 52 contact with sheet surfaces of the joining sections 33G of the grounding terminals 30G at their edges that extend in the up-and-down direction (sheet thickness surfaces) (See also FIG. 6). The inner protruding thin contact sections 52 are provided in two for each exposed surface in one grounding terminal 30G. The two inner protruding thin contact sections 52 extend in the up-and-down direction in a state that sheet surfaces thereof face each other while being adjacent to each other.

As shown in FIG. 5, the inner protruding thin contact sections 52 have inner protruding portions 52A, corresponding to the through holes 33D of the grounding terminals 30G. When the inner grounding plates 50 are attached to one sheet surface (inner surface) of the substrate 40, the inner protruding portions 52A enter the corresponding through holes 33DG, and contact with the edges (sheet thickness surface) of the outer thin protruding contact sections 62 of the outer grounding plate 60 on the other sheet surface (outer surface).

The inner grounding main body 51 has inner contact protruding portions 53, which are formed by press work at upper ends and lower ends corresponding to the grounding terminals 30G in the terminals' arrangement direction. The inner contact protruding portions 53 protrude towards exposed surfaces of the joining sections 33G of the grounding terminals 30G. The inner contact protruding portions 53 are bent in the up-and-down direction in a shape of a trapezoid when viewed in the up-and-down direction. The inner contact protruding portions 53 are to contact with sheet surfaces of the joining sections 33G of the grounding terminals 30G at their protruding apexes.

As shown in FIG. 5, at positions of the grounding terminals 30G in the terminal arrangement direction, near the upper ends, near the lower ends, and between the inner thin protruding contact sections 52, in other words, corresponding to the holding protruding portions 41 of the substrate 40, there are formed inner holding holes 54 penetrating in the sheet thickness direction for inserting the holding protruding portions 41.

As shown in FIGS. 4(A) and 5, each projecting side section 55 has a sheet surface horizontal to the sheet surface of the inner grounding main body 51. The projecting side sections 55 are joined at their side edges to the middle parts of side edges of the inner grounding main body 51 in the up-and-down direction. The projecting side sections 55 are bent in the sheet thickness direction so as to fold back an upper end part downward and a lower end part upward. Each projecting side section 55 has an upper attachment section 55A and a lower attachment section 55B to be attached to the blade holding member 70.

In addition, at an outer edge of each projecting side section 55 (an edge part on a side that is not joined to the inner grounding main body 51), there is formed a pressure-welding protruding portion 55C, which protrudes outward in the blade's widthwise direction from a middle part thereof in the up-and-down direction. As will be described, the pressure-welding protruding portions 55C are to be welded with pressure to an inner surface of the support member 80 at their ends (See FIG. 10). Here, according to the embodiment, the pressure-welding protruding portions are formed as a part of the grounding plate, but the pressure-welding protruding portions may be formed on a member other than the grounding plates. For example, it is also possible to form the pressure-welding protruding portions as protruding portions that protrude outward in the connector's widthwise direction from a side surface of the substrate of the blade.

As described above, each outer grounding plate 60 is provided on the outer surface of the substrate 40, i.e., on a surface side opposite to the contact surface to the contact sections 31A and 32A of the terminals 30 in the two sheet surfaces that are front surface and back surface of each terminal 30 (See FIGS. 4(B), 7(A), and 7(B)). Each outer grounding plate 60 is made by bending work and pressing work on sheet metal member. The outer grounding plate 60 includes an outer grounding main body 61, and projecting side sections 65. The outer grounding main body 61 of the outer grounding plate 60 has a flat quadrilateral-like shape. The projecting side sections 65 are provided both side edges of the outer grounding main body 61 in the arrangement direction of the terminals 30 (blade's widthwise direction) and respectively extend in the up-and-down direction.

As well shown in FIG. 4(B), each outer grounding main body 61 has the same dimension as the inner grounding main body in the blade's widthwise direction and extends over the range where the terminals 30 are arranged. The outer grounding main body 61 has a larger dimension than that of the inner grounding main body 51 in the up-and-down direction. In other words, the outer grounding main body 61 faces not only the joining sections 33 of the terminals 30, but also upper elastic arms 31 and lower elastic arms 32 thereof (See also FIG. 7(A)).

As shown in FIG. 5, the outer grounding main body 61 includes outer contact thin protruding portions 62, outer protruding portions 62A, outer contact protruding portions 63, and outer holding holes 64, similarly to the inner contact thin protruding portions 52, the inner protruding portions 52A, inner contact protruding portions 53, and inner holding holes 54. The outer contact protruding portions 63 extend up to the ends of the outer grounding main body 61 in the up-and-down direction, i.e., to the range where the outer contact protruding portions 63 face the upper elastic arms 31G and the lower elastic arms 32G of the grounding terminals 30G.

Figure 4:
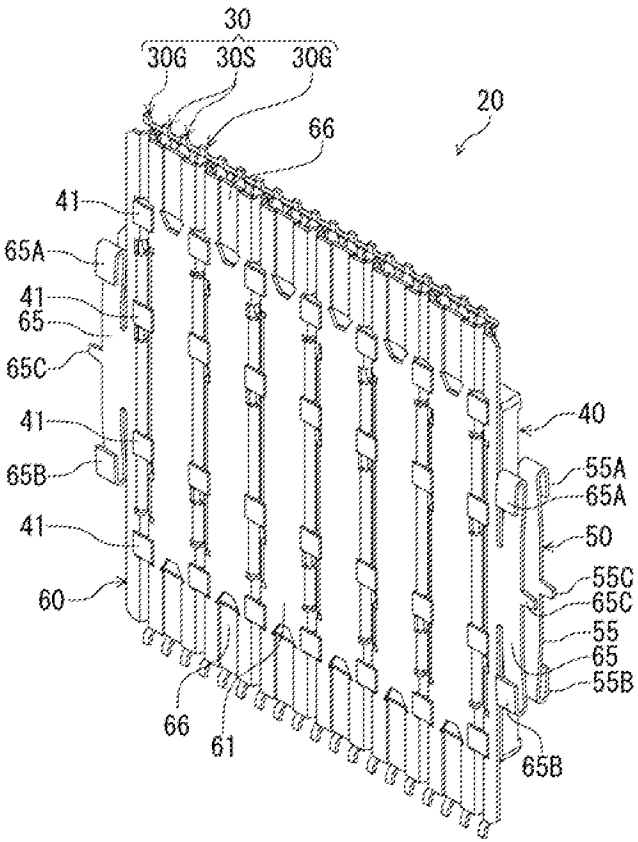
Figure 4:
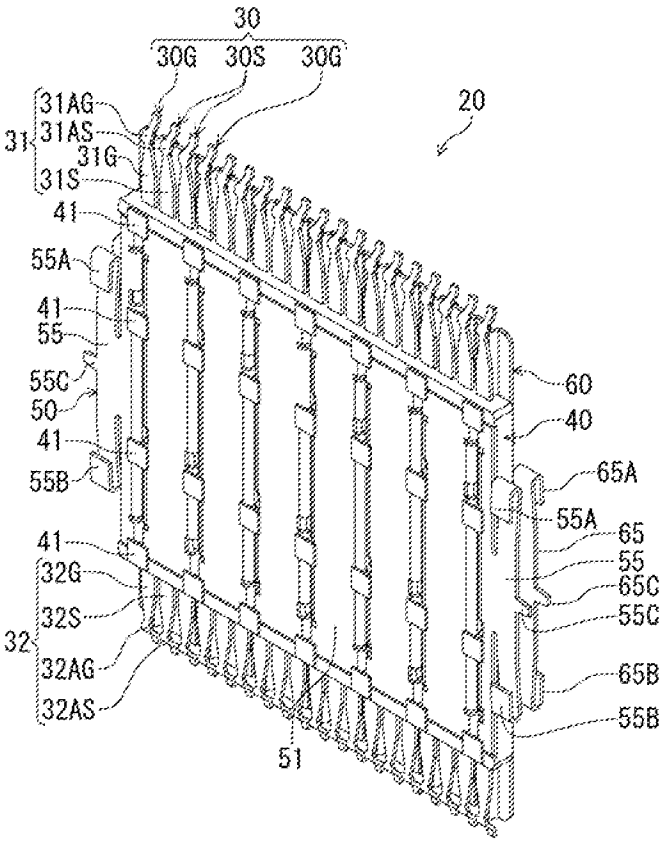

In this point, the outer contact protruding portions 63 are different from the inner contact protruding portions 53. In addition, projecting side sections 65 of the outer grounding plate 60 have the same shapes of the projecting side sections 55 of the inner grounding plate 50. As shown in FIG. 4, the projecting side sections 65 are provided so as to be symmetrical to the projecting side sections 55 about the sheet thickness direction of the blade 20.

Furthermore, as well shown in FIG. 5, the outer grounding main body 61 includes protruding pad-like sections 66. The protruding pad-like sections 66 protrude toward the elastic arms 31S and 32S in the sheet's thickness direction of the outer grounding main body 61 within the ranges corresponding to the elastic arms 31S and 32S of the signal terminals 30S that are adjacent to each other. In this point, the outer grounding main body 61 is different from the inner grounding main body 51.

Figure 16:
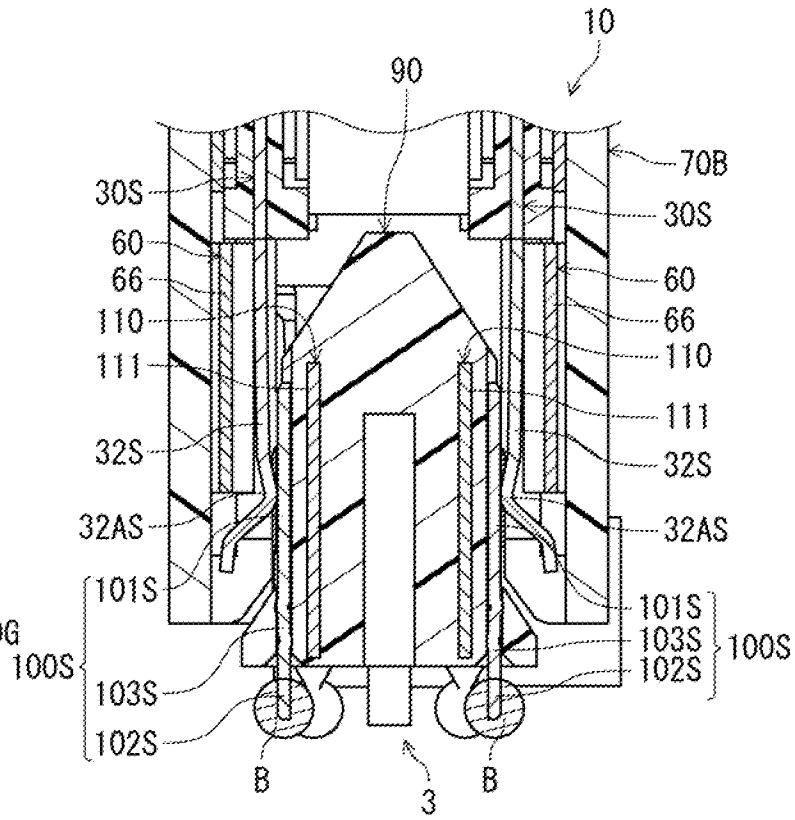
FIGS. 16(A) and 16(B) are enlarged sectional views of a fitting part of the intermediate electrical connector and the mating connector in their state of fitting to each other.
Figure 16:
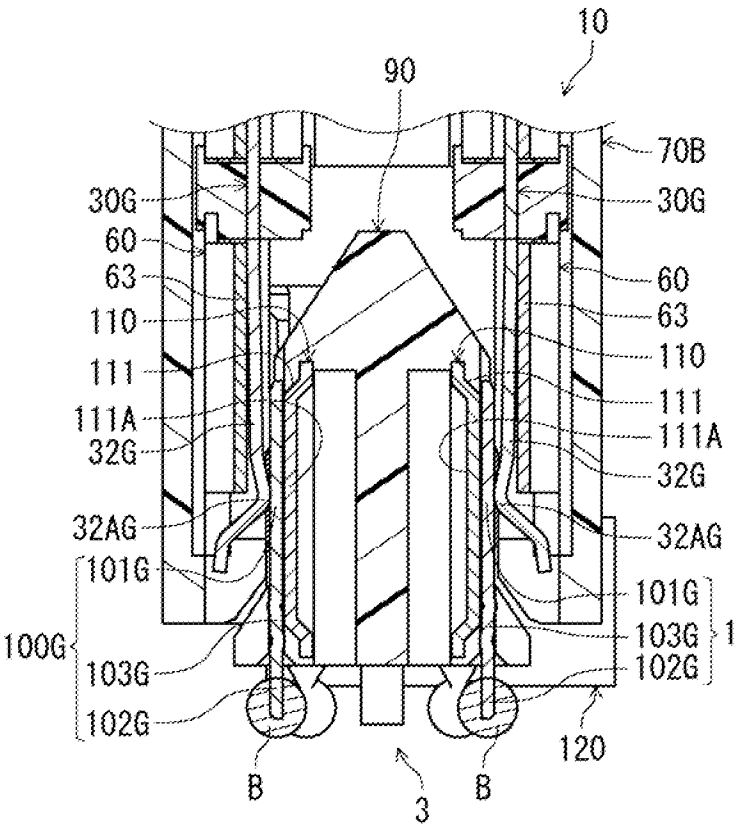

Each protruding pad-like sections 66 is formed, for example, by press work, and has a quadrilateral shape when viewed in the sheet's thickness direction. The protruding pad-like sections 66 protrude towards the elastic arms 31S and 32S without contacting thereto (See also FIG. 7(B)). According to the embodiment, the protruding pad-like sections 66 have a function of adjusting the impedance at a part contacting with the contact sections 31AS and 32AS of the elastic arms 31S and 32S and the contact sections 101S of the mating signal terminals 100S to desired values (See FIG. 16(B)).

More specifically, according to the desired impedances at the contacting parts, the amount of protruding portion of the protruding pad-like sections 66, that is, the distance between the protruding top surfaces of the protruding pad-like sections 66 and the contact sections 31AS and 32AS of the elastic arms 31S and 32S is set.

As described above, according to the first embodiment, depending on the amount of the protruding portion of the protruding pad-like sections 66, it is possible to adjust the distance between the protruding pad-like sections 66 and the contact sections 31AS and 32AS. Therefore, if the amount of protruding portions of the protruding pad-like sections 66 is adjusted to set the distance according to desired impedance upon designing the second grounding plate 60, it is possible to easily produce the second grounding plate 60 that can attain the desired impedance.

According to the first embodiment, the protruding pad-like sections 66 protrude so as to be close to the elastic arms 31S and 32S. However, in order to obtain desired values of the impedance, it is also possible to form the protruding pad-like sections 66 in a direction to be away from the elastic arms 31S and 32S.

The grounding plates 50 and 60 are attached to the substrate 40 as will be described below. First, the holding protruding portions 41 (which have cylindrical shapes at this point) of the substrate 40 are inserted in the holding holes 54 and 64 of the grounding main bodies 51 and 61. Then, the grounding plates 50 and 60 are placed to contact with corresponding sheet surfaces of the substrate 40 (See the arrow mark in FIG. 5).

In this state, edges of the protruding thin contact sections 52 and 62 of the grounding plates 50 and 60 and the protruding top surfaces of the contact protruding portions 53 and 63 contact with their corresponding sheet surfaces of the joining sections 33G of the grounding terminals 30G. Moreover, the inner protruding portions 52A of the inner protruding thin contact sections 52 and the outer protruding portions 62A of the outer protruding thin contact sections 62 enter the through holes 33DG of the joining sections 33G from the opposite sides, and contact with edges of the outer protruding thin contact sections 62 and edges of the inner protruding thin contact sections 52.

Next, while keeping the state of contacting the grounding plates 50 and 60 by their surfaces to the substrate 40, ultrasonic welding is applied thereon. As a result, the cylindrical holding protruding portions 41 are melted, deform into quadrilateral shapes when viewed in the sheet thickness direction of the substrate 40, and then solidified. Accordingly, the holding protruding portions 41 engage with the grounding plates 50 and 60 and hold the grounding plates 50 and 60 (See FIG. 6).

Moreover, the portions where the inner protruding portions 52A contact with the edges of the outer protruding thin contact sections 62 and the portions where the outer protruding portions 62A and the inner protruding thin contact sections 52 are melted and solidified to be integrated to each other. Accordingly, the inner grounding plate 50 and the outer grounding plate 60 are electrically connected. According to the first embodiment, the holding protruding portions 41 are ultrasonically welded and the parts where the protruding portions 52A and 62A contact with the protruding thin contact sections 62 and 52 are ultrasonically welded. The ultrasonic welding may not have to be applied in the both steps, but can be applied in only one of those steps.

As described above, according to the embodiment, the edges of the protruding thin contact sections 52 and 62 of the grounding plates 50 and 60 abut the both sheet surfaces of the joining sections 33G of the grounding terminals 30G. On the other hand, the protruding portions 52A and 62A of the grounding plates 50 and 60 are respectively welded to the edges of the protruding thin contact sections 62 and 52 of the grounding plates 60 and 50.

Figure 6:
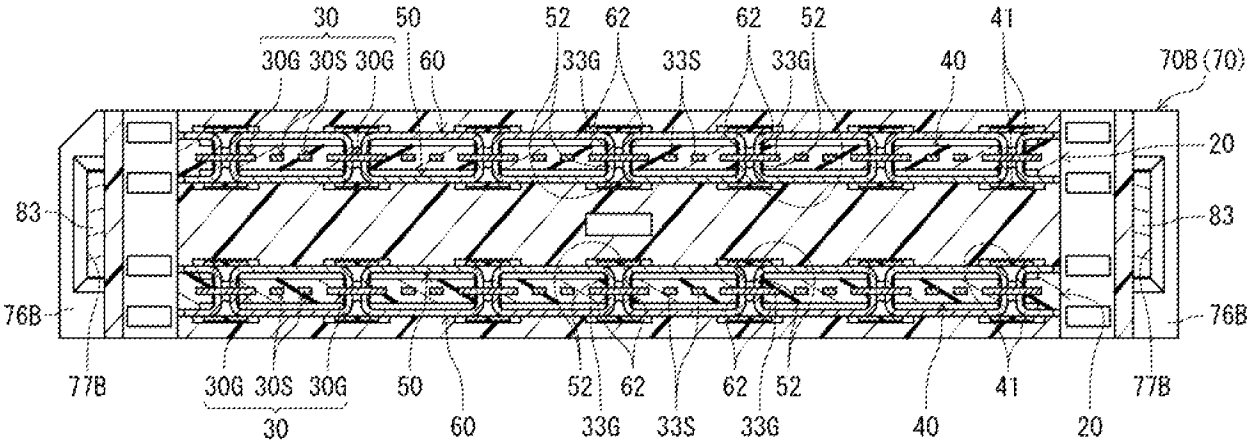
FIG. 6 is a sectional view showing the intermediate connecting member, taken along a surface perpendicular to an up-and-down direction thereof.

Therefore, as shown in FIG. 6, the joining sections 33S of each pair, which is composed of two signal terminals 30S that are adjacent to each other, are surrounded by the grounding plates 50 and 60 and the joining sections 33G of the two grounding terminals 30G when viewed in the up-and-down direction, and shielded from the outside. As a result, it is possible to securely prevent the respective pairs from cross talks between pairs. In addition, it is also possible to securely transmit signals without influence of noises from outside.

In addition, in the area that corresponds to the elastic arms 31 and 32 of the terminals 30 in the up-and-down direction, onto one sheet surfaces of the elastic arms 31G and 32G of the grounding terminals 30G (sheet surface on a side of the outer grounding plate 60), the contact protruding portions 63 of the grounding plate 60 contact by surface. Therefore, the elastic arms 31S and 32S of each pair, which is composed of the two adjacent signal terminals 30S, are shielded from outside on a side of the one sheet surface when viewed in the up-and-down direction.

As a result, as will be described later, in a state the connectors are fitted, in addition to the shielding of the mating signal terminals 100S by the mating grounding plates 110 of the mating connectors 2 and 3, it is possible to securely shield the contacting parts of the signal terminals 30S and 100S from outside.

The blade holding member 70 is made of an electrically insulating material. As shown in FIG. 1, the blade holding member includes an upper holding body 70A and a lower holding body 70B, which have the same shape. While being in a state the inner surfaces of the two blades 10 face each other, the blade holding member 70 houses and holds therein generally upper half of the both blades 10 with the upper holding body 70A thereof, and houses and holds therein generally lower half part of the both blades 10 with the lower holding body 70B thereof (See FIGS. 3(B), 7(A), and 7(B)).

As shown in FIG. 1, the upper holding body 70A and the lower holding body 70B are disposed at certain distance away from each other in the up-and-down direction. Accordingly, middle parts of the blades 20 in the up-and-down direction are exposed in the range of the distance therebetween. The tips of the pressure-welding protruding portions 55C and 65C of the grounding plates 50 and 60 protrude outward in the connector's widthwise direction than the outer surfaces of the end walls 72A and 72B of the blade holding member 70, which will be described later (See FIGS. 3(A) and 10).

Hereunder, the configuration of the lower holding body 70B will be mainly described. As for the upper holding body 70A, the explanation will be omitted by affixing "A" in place of "B" of reference numerals of the respective parts of the lower holding section 70B.

As shown in FIG. 3(B), the lower holding body 70B includes two long walls 71B and two short walls 72B. The long walls 71B extend in the connector's widthwise direction (blade's widthwise direction). The short walls 72B extend in an arrangement direction of the intermediate connecting members 10 and joins ends of the long walls 71B. The lower holding body 70B generally has a shape of a rectangular parallelepiped as a whole.

Moreover, at a center of the lower holding body 70B in the arrangement direction, there is formed one dividing wall 73B. The dividing wall 73B extends in the connector's widthwise direction between the two long walls 71B and joins inner wall surfaces of the two end walls 72B. Being surrounded by the long walls 71B, the short walls 72B, and the dividing wall 73B and penetrating in the up-and-down direction, there are two spaces that form blade-housing holes 74B to respectively house the blades 20.

The long walls 71B include lower attachment holes 75B relatively near the both side edges and relatively near upper end in the up-and-down direction. The lower attachment holes 75B engage with the lower attachment sections 65B of the outer grounding plate 60 provided on the blades 20. The lower attachment holes 75B are through holes penetrating in the wall thickness direction.

Moreover, the dividing wall 73B includes lower attachment sections 55B (not illustrated) directly facing to the lower attachment holes 75B. The lower attachment holes 55B engage with the lower attachment sections 55B of the inner grounding plate 50 and are through holes penetrating in the wall thickness direction.

On a side surface (which includes an outer surface of the short walls 72B) of the lower holding body 70B, there is formed a lower supported portion 76B. The lower supported portions 76B protrude outward in the connector's widthwise direction from outer surfaces of the lower parts of the short walls 72B, and are supported by the lower supporting members 83 of the support members 80. Each lower supported portion 76B includes a slit-like lower hole to be supported 77B. The respective slit-like lower holes to be supported 77B extend perpendicular to the connector's widthwise direction and penetrate in the up-and-down direction. The lower holes to be supported 77B receive and house the lower supporting members 83 of the support members 80 from thereabove.

At a lower part of each lower holding body 70B, there is formed a slit-like end groove portion section 78B. The slit-like end groove portion sections 78B are opened downward near the ends in the connector's widthwise direction (slightly inner but adjacent to the lower supported portions 76B). As shown in FIG. 2, in a state that the connectors are fitted, the end groove portion sections 78B receive an upper part of a connecting member 120 of the mating connector 3, which will be described later.

The support members 80 are made by punching a sheet metal piece, keeping flat surfaces of the sheet metal piece. As shown in FIG. 2, the support members 80 are formed as flat members, which extend in the arrangement direction of the intermediate connecting members 10 and in the up-and-down direction.

Each support member 80 extends over the arrangement range of the relaying connecting bodies 10 in the arrangement direction, and over the generally the whole area of the intermediate connecting members 10 in the up-and-down direction, while having a slightly smaller dimension than the intermediate connecting members 10 in the direction. The support members 80 face the respective side surfaces of the intermediate connecting members 10 (See also FIG. 10). Accordingly, covering generally the whole area of the respective side surfaces of the intermediate connecting members 10 with the support members 80, it is possible to obtain satisfactory shielding effect.

As shown in FIG. 1, each support member 80 includes a main body 81, upper supporting members 82, and lower supporting members 83. Each main body 81 continues to extend in the arrangement direction and has its sheet surface exposed in a state of supporting the intermediate connecting members 10. The upper supporting members 82 extend upward from an upper edge of the main body 81 (See FIGS. 9(B) and 10). The lower supporting members 83 extend downward from a lower edge of the main body 81 (FIG. 10).

Each main body 81 includes strip-like sections 81A and relay sections 81B. The strip sections 81A are provided corresponding to the respective intermediate connecting members 10 in the arrangement direction, and cover side surfaces of the intermediate connecting members 10. The relay sections 81B are provided corresponding to spaces between the intermediate connecting members that are adjacent to each other in the arrangement direction, and join facing edges (edges extending in the up-and-down direction) of the strip sections 81A. The relay sections 81B are formed at center area of the strip-like sections 81A in the up-and-down direction, protruding from side edges of the strip-like sections in the arrangement direction. As well shown in FIG. 1, according to the first embodiment, five strip-like sections 81A are connected with the relay sections 81B to be continuous in the arrangement direction.

Figure 9:
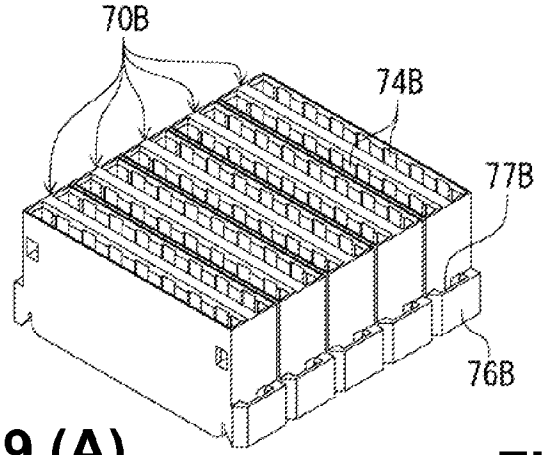
FIGS. 9(A) through 9(D) are perspective views showing the steps of assembling the intermediate electrical connector.
Figure 9:
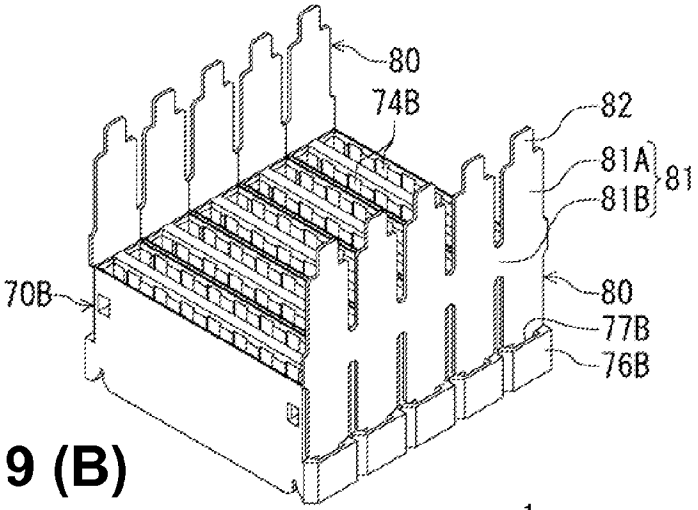
Figure 9:
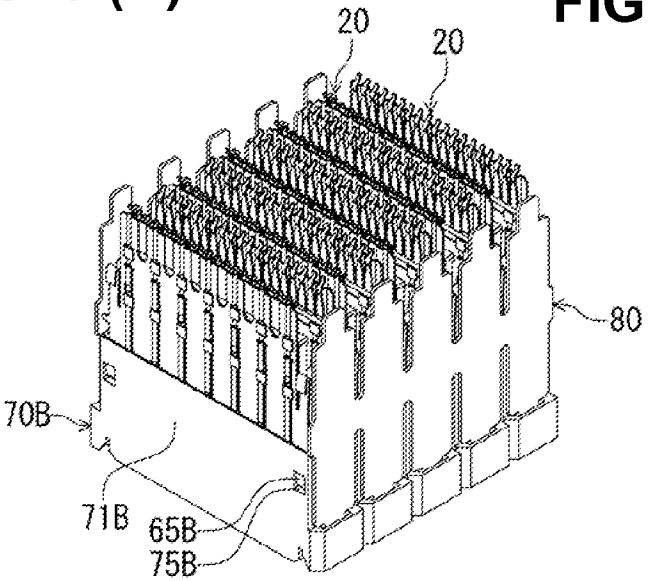
Figure 9:
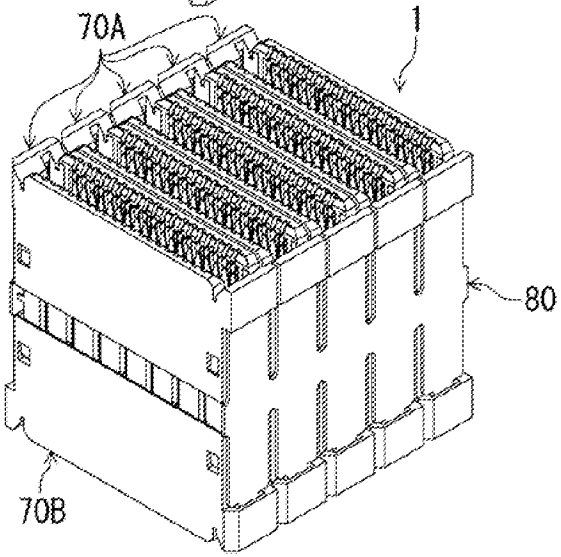
Figure 10:
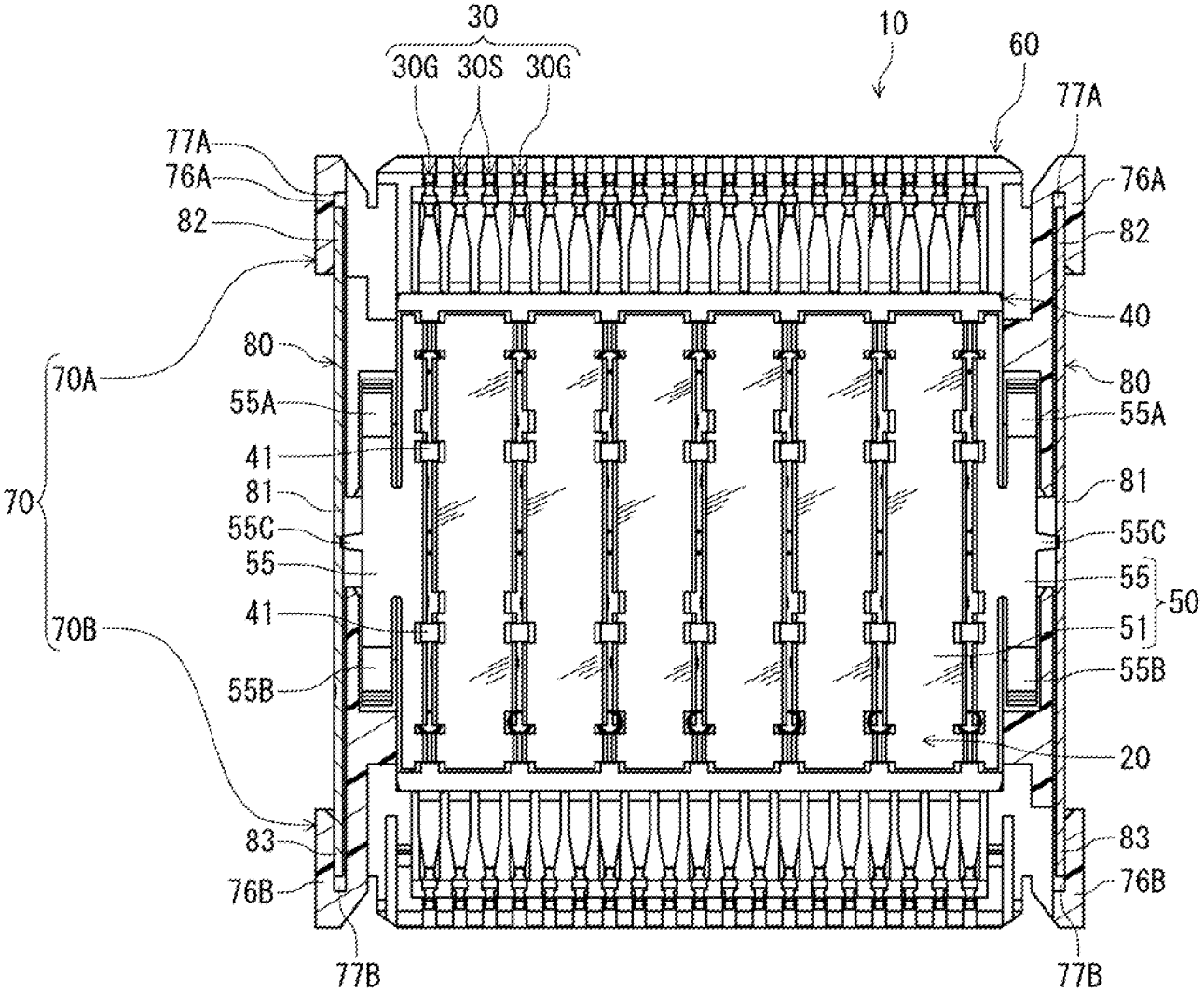
FIG. 10 is a sectional view showing the intermediate electrical connector taken at a surface perpendicular to an arrangement direction of the intermediate electrical connectors, more specifically which is taken at a sheet surface of the inner grounding plate.

As shown in FIG. 9(B), the upper supporting members 82 are strip-like sections extending upward from an upper edges of the strip-like sections 81A. The upper supporting members 82 have smaller dimension in the arrangement direction than the strip-like sections 81A and the upper holes to be supported 77A of the intermediate connecting members 10.

Figure 11:
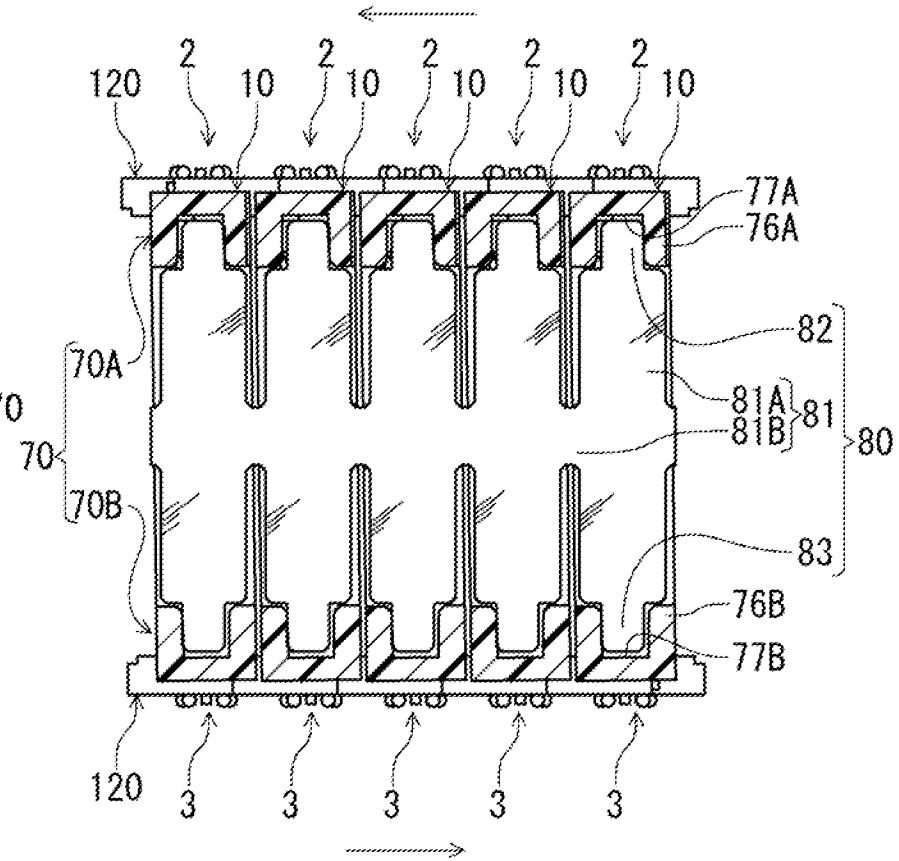
Figure 11:
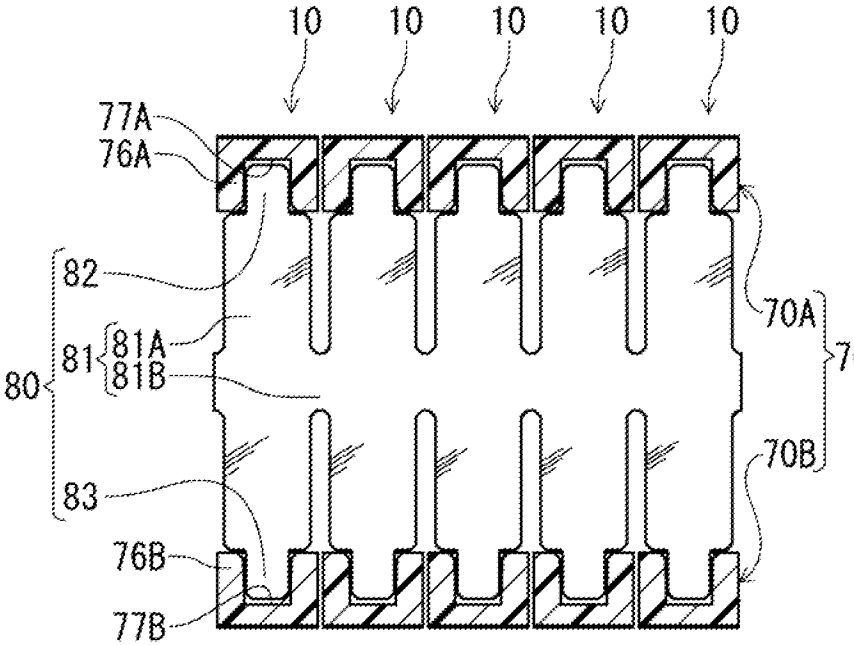

Therefore, when the upper supporting members 82 are housed in the upper holes to be supported 77A of the upper holding body 70A, as shown in FIG. 11(A), there are formed gaps between facing inner wall surfaces (inner surfaces perpendicular to the arrangement direction) of the upper holes to be supported 77A in the arrangement direction and side edges of the upper supporting members 82. As will be described later, those gaps allow the intermediate connecting members 10 to make tilting motions.

The lower supporting members 83 have the same configurations as the upper supporting members 82, and have the same shapes of the upper supporting members 82 but turned upside down. The explanation of the lower supporting members 83 will be omitted by affixing reference numeral that "1" is added to reference numerals of corresponding parts of the upper supporting members 82.

As shown in FIG. 10, according to the first embodiment, tips of the pressure-welding protruding portions 55C and 65C of the grounding plates 50 and 60 protrude outward from outer surfaces of the short walls 72A and 72B of each blade holding member 70 in the connector's widthwise direction, and contact by pressure to inner surfaces of the support members 80 towards outside in the connector's widthwise direction. Therefore, the upper and lower supporting members 82 and 83 of the support members 80 energize the outer inner wall surfaces (surfaces that contact by pressure with outer sheet surfaces of the upper and the lower supporting members 82 and 83) of the support holes 76A and 76B towards outside in the connector's widthwise direction.

As a result, there is no backlash in the connector's widthwise direction between the respective holding bodies 70 and the support members 80, and the blade holding member 70 is securely kept at a normal position in the connector's widthwise direction. Therefore, it is easier to connect the relay connector 1 to the mating connecting bodies 2 and 3. In addition, by pressure welding the pressure-welding protruding portions 55C and 65C to inner surfaces of the support members 80, the support members 80, which are metal members, and the grounding plates 50 and 60 are electrically connected to each other. Therefore, it is possible to improve the grounding effect.

According to the first embodiment, the support member 80 includes sections (referred to as "vertically long flat section), each of which is composed of the strip-like section 81A, the upper supporting member 81A, and the lower supporting member 83. The vertically long sections are connected with relay sections 81B so as to have a repetitive configuration in the arrangement direction of the intermediate connecting members 10 as a whole.

Therefore, it is possible to suitably obtain the support member 80 by preparing a sheet metal piece, in which a number of the vertically long flat sections are connected with the relay sections 81B, and then cutting the sheet metal piece in a suitable length for the number of the intermediate connecting members 10 (a dimension in the arrangement direction). As a result, even when the number of the intermediate connecting members 10 and the space between the intermediate connecting members 10 increase or decrease upon designing, it is still possible to make a desired length of the support members 80 from one type of sheet metal piece by cutting the sheet metal piece according to the number of or space between the intermediate connecting members 10.

Therefore, it is possible to restrain the manufacturing cost. Here, according to the first embodiment, the support members 80 are made from the sheet metal piece, but a material of the support members 80 is not limited to this. For example, it is possible to make the support members 80 from resin.

The relay connector 1 of the embodiment may be produced as described below. First, the step of making the blades 20 will be described. Dividing a plurality of terminals 30 to be provided in one blade 20 into two groups, there are provided two types of terminal groups (illustrated in FIGS. 8(A) and 8(B), respectively). Putting the two types of terminal groups together, a row of the terminals 30 to be provided in one blade 20 is formed as shown in FIG. 8(C).

Then, placing the row of the terminals 30 in a mold (not illustrated) for molding the substrate 40, molten resin is poured into the mold and solidified so as to integrally mold the row of the terminals 30 and the substrate 40. After that, of the two sheet surfaces of the substrate 40, an inner surface (sheet surface provided on a side of contact surfaces of the contact sections 31 and 32 of the terminals 30) is attached to the inner grounding plate 50. The outer surface (sheet surface provided on a side opposite the contact surfaces of the contact sections 31 and 32 of the terminals 30) of the substrate 40 is attached to the outer grounding plate 60.

As described above, those surfaces of the substrate 40 are attached to the inner grounding surface 50 and the outer grounding surface 60 by ultrasonic welding and thereby the blade 20 is completed (FIG. 5).

Next, assembling of the relay connector 1 will be described. First, as shown in FIG. 9(A), a plurality of lower support members 70B is arranged in the arrangement direction of the intermediate connecting members 10. As shown in FIG. 9(B), the lower supporting members 83 of the supporting members 70B are inserted in the lower holes to be supported 77B, which are provided on the both side surfaces of the respective lower holding bodies 70B, from thereabove.

Thereafter, as shown in FIG. 9(C), the inner surfaces of the two blades 20, which are respectively held by the lower holding bodies 70B, are placed so as to face each other. Then, lower parts of the respective blades 20 are housed in the blade housing holes 74B of the lower holding bodies 70B from thereabove.

At this point, into the lower attachment holes 75B of the longer walls 71B and the lower attachment holes (not illustrated) of the dividing wall 73B of each lower holding body 70B, the lower attachment sections 65B of the outer grounding plate 60 and the lower attachment sections 55B of the inner grounding plate 50 of each blade 20 are housed and locked in the lower attachment holes. As a result, it is possible to prevent the blades 20 from coming off upward from the lower holding bodies 70B.

Then, as shown in FIG. 9(D), while being turned upside down relative to the lower holding bodies 70B, the upper holding bodies 70A are mounted on the respective corresponding blades 20 from thereabove. This assembling procedure is similar to the one for mounting the blades 20 on the lower holding bodies 70B. Accordingly, assembling of the relay connector 1 is completed.

Next, configurations of the mating connectors 2 and 3 will be described. As shown in FIG. 1, according to the first embodiment, the intermediate connecting members 10 and the mating connectors 2 and 3, each of which is provided in the same number as that of the intermediate connecting members 10, are arranged at constant intervals in the same direction as the arrangement direction of the intermediate connecting members 10. All the mating connectors 2 and 3 are connected with connecting members 120, which will be described later. The mating connectors 2 and 3 have the same configuration. Therefore, the configuration of the mating connectors 3 will be mainly described. The explanation of the mating connectors 2 will be omitted affixing the same reference numerals as those of the mating connectors 3.

Figure 12:
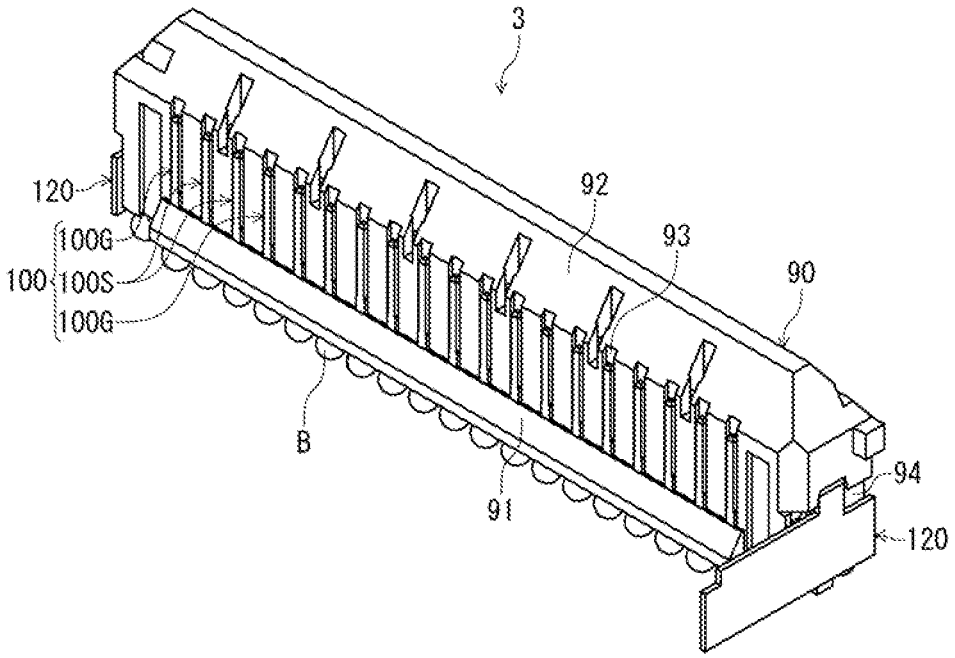
FIG. 12 is a perspective view showing one of the mating connectors.
Figure 13:
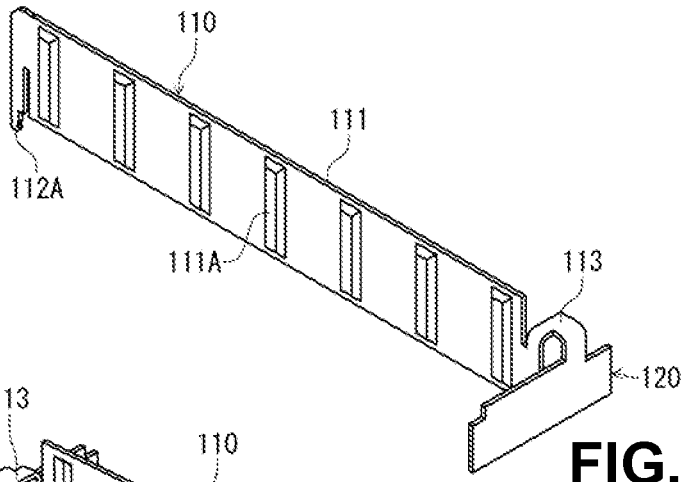
Figure 13:
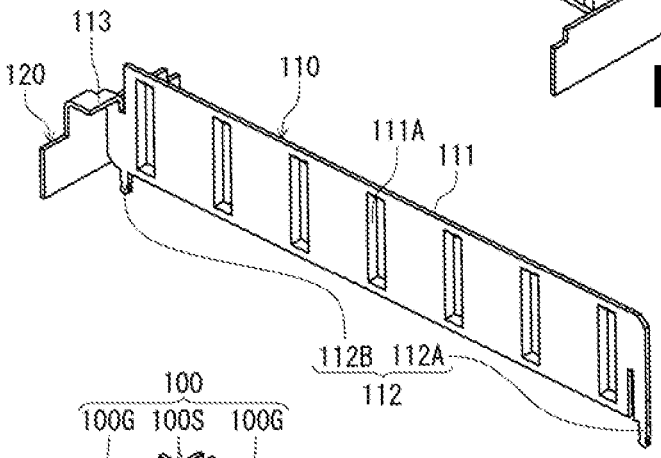
Figure 13:
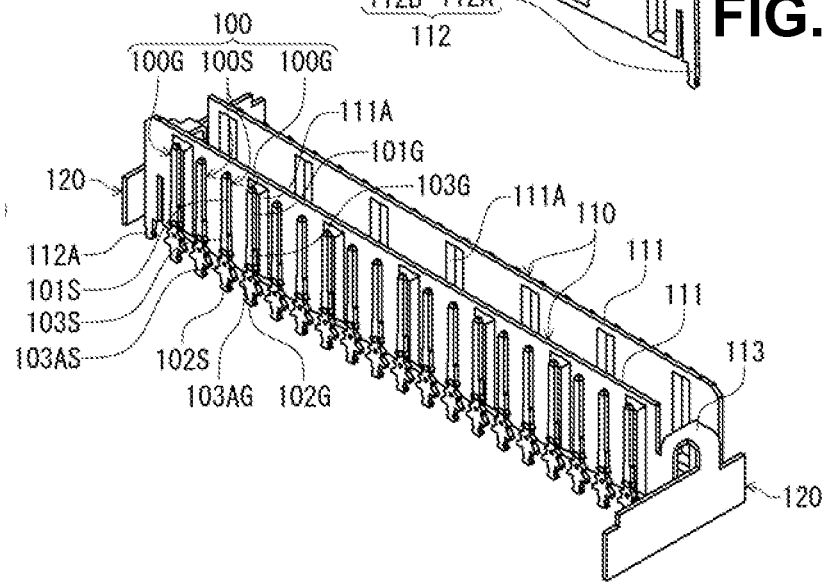

As shown in FIG. 12, each mating connector 3 includes a housing 90, a plurality of terminals 100 (hereinafter referred to as "mating terminals 100"), and two mating grounding plates 110. The housing 90 is made of an electrically insulating material and extends having the connector's widthwise direction as its longitudinal direction. The mating terminals 100 are arranged and held by the housing 90 in the connector's widthwise direction. The housing 90 also holds the two mating grounding plates 110 (See FIGS. 13 through 16).

As shown in FIG. 1, the housing 90 extends having the connector's widthwise direction as its longitudinal direction. The housing 90 has generally the same dimension as that of the relay connector 1 in the connector's widthwise direction. As shown in FIG. 12, the housing 90 includes a basal section 91 that forms a lower part of the housing 90, and fitting wall sections 92 that rises upward from the basal section 91. The fitting wall sections 92 are formed as fitting sections to be fitted in the lower receiving sections 12 of the intermediate connecting members 10.

Furthermore, each housing 90 includes a plurality of terminal housing sections 93 that extend in the up-and-down direction. The plurality of terminal housing sections 93 is arranged at constant intervals in the connector's widthwise direction and holds the mating terminals 100 therein. The terminal holding sections 93 are formed as groove portions on both wall surfaces (surfaces perpendicular to the arrangement direction of the mating connectors 3) of the fitting wall sections 92, which extend in the connector's widthwise direction in the range where the fitting wall sections 92 are present in the up-and-down direction.

The terminal housing sections 93 are formed as through holes, which connect to the groove portions and penetrate the basal section 91 in the range where the basal section 91 is present in the up-and-down direction.

In addition, the terminal housing sections 93 to house the mating grounding terminals 100G have openings (FIGS. 14(A) and 14(B)) opened on their grove bottoms towards a mating side in the arrangement direction. From the openings, mating contact sections 101G and mating joining sections 103G of the mating grounding terminals 100G, which will be described later, are exposed. As a result, as will be described later, the grounding contact sections 111A of each mating grounding plate 110 can contact with mating contact sections 101G and mating joining sections 103G of the mating grounding terminals 100G (See FIG. 14(B)).

As shown in FIG. 12, on both side surfaces (surfaces perpendicular to the connector's widthwise direction) of each housing 90, there are formed recessed sections 94, which are formed being recessed only on lower parts of the sides of each housing 90. Those recessed sections 94 are recessed in the amount of a thickness of the connecting member 120, which will be described later, and are formed so as to place the connecting members 120 in the recessed sections 94.

As shown in FIG. 13(C), the mating terminals 100 are made by punching a sheet metal piece in the thickness direction thereof and have strip-like shapes extending in the up-and-down direction as a whole. As shown in FIG. 12, the mating terminals 100 are pressed in the terminal housing sections 93 of each housing 90 from thereunder, and arranged in the connector's widthwise direction. The plurality of mating terminals 100 is used as signal terminals 100S (hereunder referred to as "mating signal terminals 100S") or grounding terminals 100G (hereunder referred to as "mating grounding terminals 100G").

According to the first embodiment, the mating terminals 100 are arranged so as to correspond the arrangement of the signal terminals 30S and the grounding terminals 30G, which are provided on the blades 20 of each intermediate connecting member 10.

More specifically, as shown in FIGS. 13(C) and 14(A), the mating terminals 100 are arranged such that the two adjacent mating signal terminals 100S are placed between the mating grounding terminals 100G. Hereunder, when it is not necessary to specially distinguish between the mating signal terminals 100S and the mating grounding terminals 100G, they are simply referred to as "mating terminals 100" for description of the configuration.

Here, FIG. 14(A) is a sectional view of the mating connector 3, taken at a position of the joining section 103 in the mating terminals 100 in the up-and-down direction when viewed from thereunder.

As well shown in FIG. 14(A), the mating terminals 100 are provided on both sheet surfaces of the fitting wall sections 92 of the housing 90, and are provided in two rows that is symmetrical about the fitting wall sections 92 in the wall's thickness direction of the fitting wall sections 92 (the arrangement direction of the mating connectors 3). As shown in FIGS. 14(B) and 14(C), each mating terminal 100 includes a mating contact section 101 formed on an upper end side thereof, a mating connecting section 102 formed on a lower end side thereof, and a mating joining section 103 that joins the mating contact section 101 and the mating connecting section 102.

As shown in FIG. 13(C), each mating joining section 103 includes press-in protruding portions 103A for pressing in the terminal housing section 93. The press-in protruding portions 103A are formed protruding from the both side edges of the mating joining section 103.

Each mating contact section 101 contacts with the lower contact section 32A of the terminal 30 of the relay connector 1 (See FIGS. 16(A) and 16(B)). More specifically, the mating contact sections 101S of the mating signal terminals 100S contact with the lower contact sections 32AS of the signal terminals 30S. The mating contact sections 101G of the mating grounding terminals 100G contact with the lower contact sections 32AG of the grounding terminals 30G.

In addition, as shown in FIGS. 14(B) and 14(C), the connecting sections 102 protrude from a bottom surface of the basal section 91 of each housing 90, and have solder balls B respectively attached thereto. The connecting sections 102 are formed so as to be connected to corresponding circuit unit (not illustrated) of a circuit board by soldering. More specifically, the connecting sections 102S of the mating signal terminals 100S are connected to a signal circuit unit. The connecting sections 102G of the mating grounding terminals 100G are connected to a grounding circuit unit.

Each mating grounding plate 110 is made from a sheet metal piece by press work and bending work. As shown in FIGS. 13(A) through 13(C), each mating grounding plate 110 includes a mating grounding main body 111 and grounding legs 112. The mating grounding main body 111 has sheet surfaces perpendicular to the arrangement direction of the mating connectors 3, and extends over generally the whole area where the mating connector 3 is present in the connector's width direction.

The grounding legs 112 extend downward from both ends of a lower edge of the mating grounding main body 111 in the connector's widthwise direction. In addition, the mating grounding plate 110 also includes a joining section 113. The joining section 113 connects the mating grounding main body 111 and the connecting member 120, which will be described later.

As shown in FIG. 14(A), the mating grounding main body 111 extends in a middle of the fitting wall section 92 of the housing 90 in the range of wall's thickness thereof, that is, extends in the connector's widthwise direction between the rows of mating terminals 100. In other words, the mating grounding main body 111 is provided on a side opposite the contact surfaces of the mating contact sections 101, which is one of two sheet surfaces of the mating terminals 100.

In addition, as shown in FIGS. 14(B) and 14(C), the mating grounding main body 111 is provided corresponding to the range where the mating contact sections 101 and the mating joining sections 103 of the mating terminals 100 are present in the up-and-down direction.

As shown in FIGS. 14(A) and 14(B), each mating grounding main body 111 includes grounding contact protruding portions 111A, which protrude towards the mating grounding terminals 100G and extend in the up-and-down direction at the same positions as those of the mating grounding terminals 100G in the arrangement direction of the mating terminals 100. The grounding contact protruding portions 111A are formed by press work (See also FIGS. 13(A) through 13(C)). As shown in FIGS. 14(A) and 14(B), the grounding contact protruding portions 111A contact with sheet surfaces of the mating contact sections 101G and the mating joining sections 103G of the mating grounding terminals 100G at their protruding ends.

As described above, according to the first embodiment, the grounding contact sections 111A contact with sheet surfaces of the mating contact sections 101G and the mating joining sections 103G. Therefore, as shown in FIG. 14(A), the mating contact sections 101G and the mating joining sections 103G of each pair composed of two adjacent signal terminals 30S are shielded from outside on a side of a sheet surface that faces the mating grounding plate 110 in the up-and-down direction (FIG. 14(A) only shows shielding of the mating joining section 103G).

As already described, in the intermediate connecting members 10 of the relay connector 1, the elastic arms 32S of the two signal terminals 30S are shielded from outside on a side of sheet surface that faces the outer grounding plate 60 (See FIG. 16(B)). Therefore, according to the first embodiment, in a state that the connectors are fitted, the contacting parts of the contact sections 32AS and the mating contact sections 101S in the respective pairs are surrounded by the outer grounding plate 60, two grounding terminals 30G, the mating grounding plate 110, and two mating grounding terminals 100G, and shielded from outside.

As a result, in the contacting parts, it is possible to securely prevent cross talks between the pairs. It is also possible to securely transmit signals without influence of noises from outside. The contact parts between the signal terminals 30S are shielded similarly also in a state that the relay connector 1 and the mating connectors 2 are fitted.

As shown in FIGS. 13(C) and 14(A), according to the first embodiment, two mating grounding plates 110 are provided being symmetrical such that the grounding contact protruding portions 111A protrude towards the opposite side in the arrangement direction (wall's thickness direction of the fitting wall sections 92). As well shown in FIG. 14(A), the two mating grounding plates 110 are held by integral molding with the housing 90.

Each first grounding legs 112A is provided at one end of the mating grounding main body 111 in the connector's widthwise direction (on a side where the connecting member 120 is not connected thereto). As shown in FIGS. 13(A) through 13(C), each first grounding leg 112A is formed as a strip-like section outside the range where the mating terminals 100 are arranged.

Each first grounding leg 112A extends downward from generally a center of the mating grounding main body 111 in the up-and-down direction. Moreover, a second grounding leg 112B is provided at the other end of the mating grounding main body 111 (on a side that the connecting member 120 is joined thereto).

As shown in FIG. 13(B), each second grounding leg 112B is formed as a strip-like section, which extends downward from the same position as the lower edge of the mating grounding main body 111 in the up-and-down direction, outside the range of where the mating terminals 100 are arranged. As shown in FIG. 13(C), the first and the second grounding legs 112A and 112B have their ends slightly above the connecting sections 102 of the mating terminals 100, and are to be connected by soldering to corresponding grounding circuit unit (not illustrated) of a circuit board.

At the other end of each mating grounding main body 111, there is formed joining section 113 that joins the connecting member 120 to the mating grounding main body 111.

As shown in FIGS. 13(A) and 13(B), each joining section 113 is bent at a right angle at an upper edge of the other end of the mating grounding main body 111 (a portion closer to the other end than the grounding leg 112B) and bent at a right angle downward at an outer edge thereof. The joining section 113 is joined to an upper edge of the connecting member 120.

FIGS. 15(A) through 15(D) are perspective views showing the steps of making the plurality of mating grounding plates 110 connected to carriers. First, as shown in FIG. 15(A), metal workpieces are prepared, in which both ends of a plurality of grounding plates are respectively joined to carriers C (which will be used as connecting sections 120 later).

Each metal workpiece has sheet surfaces such that the mating grounding plates 110 and the carriers C are horizontal to each other, and looks like a plate member as a whole. Then, as shown in FIG. 15(B), one of the carriers C on a side of one ends of the grounding plates 110 is removed by cutting. Boundary parts between the joining sections 113 and the grounding main body sections 111 are bent at a right angle so as to have the respective mating grounding main bodies 111 rise.

Figure 14:
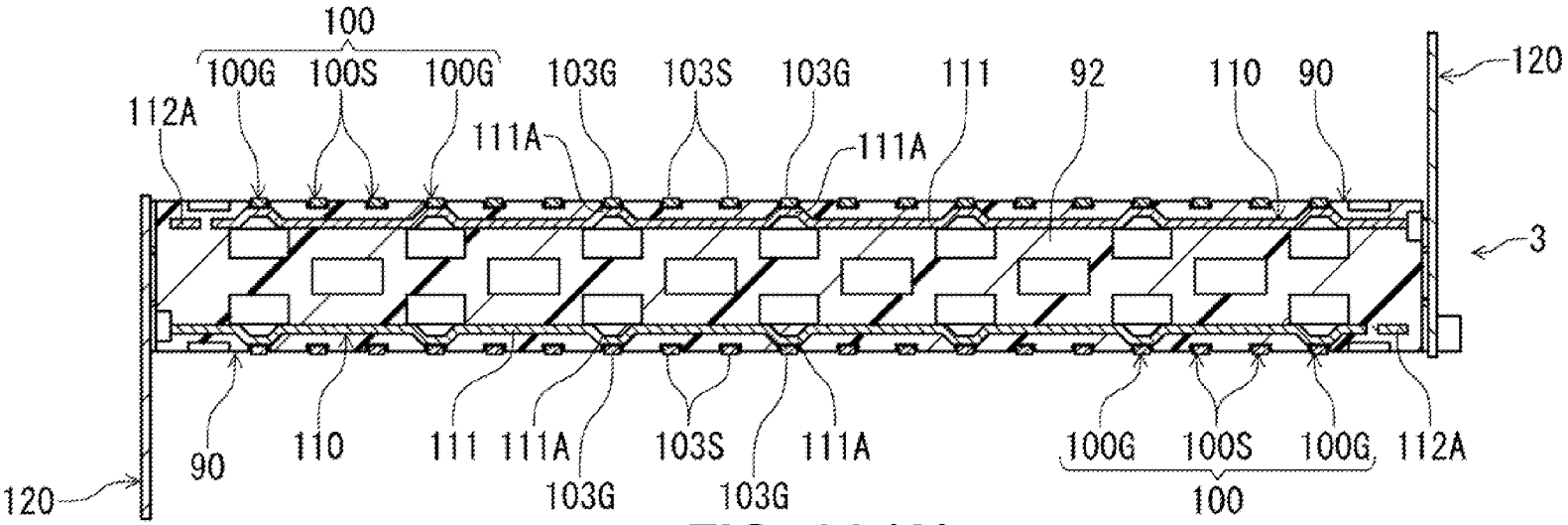
Figure 14:
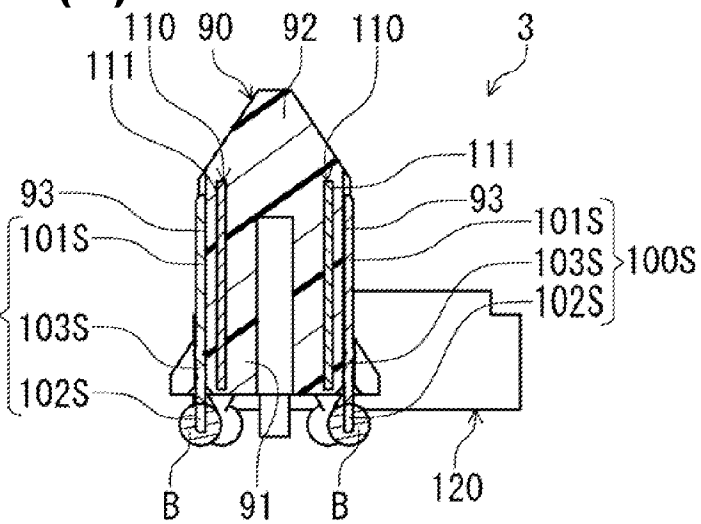
Figure 14:
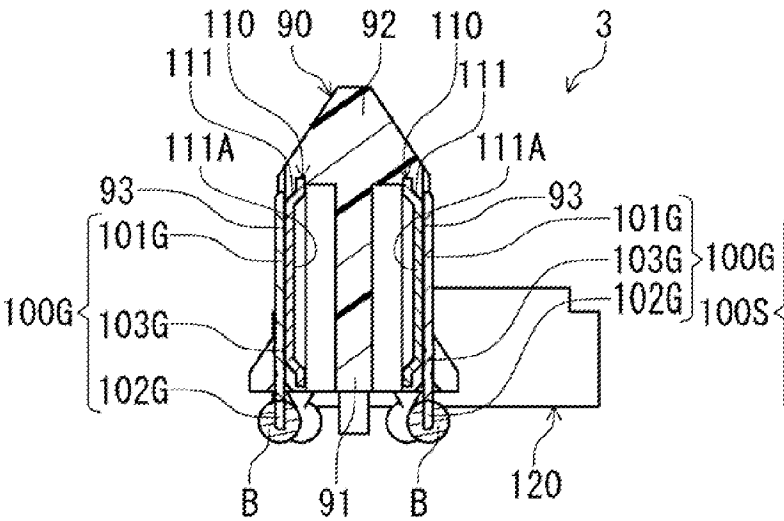
Figure 15:
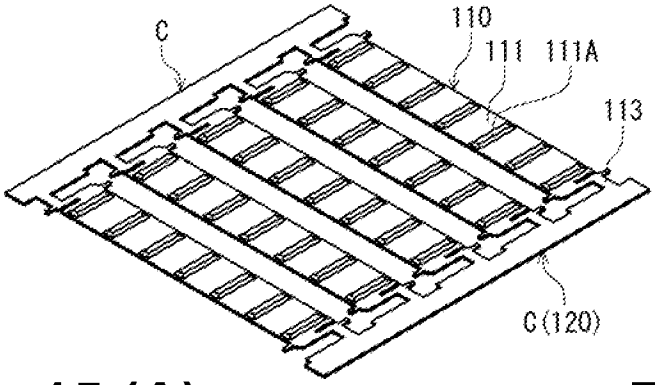
FIGS. 15(A) through 15(D) are perspective views showing the steps of fabricating a plurality of mating grounding plates.
Figure 15:
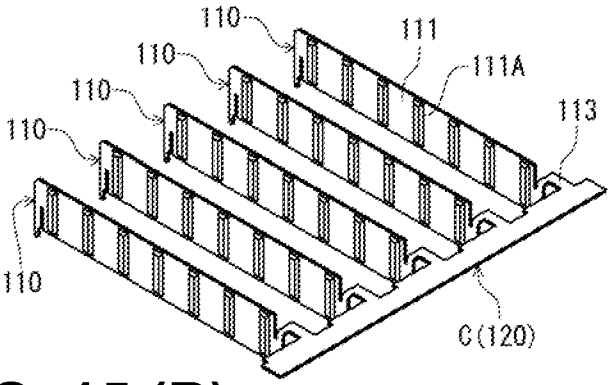
Figure 15:
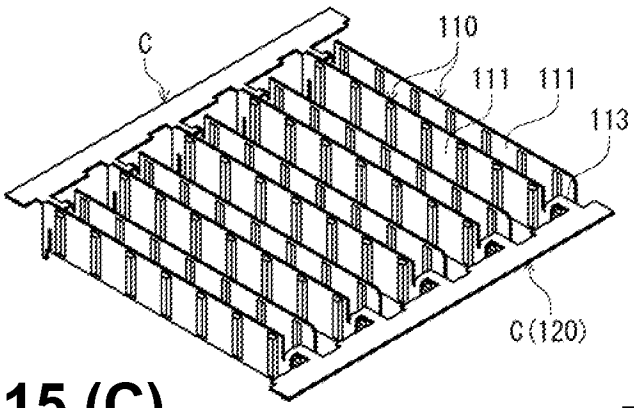
Figure 15:
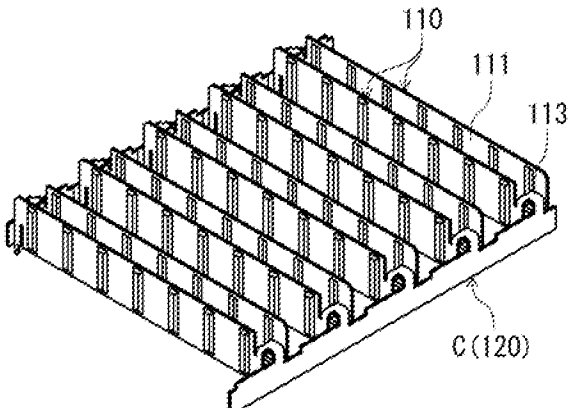

Thereafter, as shown in FIG. 15(C), two metal workpieces of FIG. 15(B) are put together, such that the mating grounding plates 110 of the respective metal workpieces are alternately arranged in the arrangement direction of the mating connectors 3 (a longitudinal direction of the carrier C). At this point, the mating grounding plates 110 of each pair symmetrically face each other in the arrangement direction of the mating connectors 3. Then, as shown in FIG. 14(D), the carriers C of the two metal workpieces are bent downward at right angle at a boundary between the joining sections 113 and the carriers C. As a result, the sheet surfaces of the carriers C are perpendicular to the connector's widthwise direction and the carriers C can be used as the connecting members 120. Thereafter, the respective two mating grounding plates 110 in FIG. 14 are integrally molded with the housing 90, keeping the attitude.

As described above, according to the first embodiment, the connecting members 120 are originally the carriers C connected to the plurality of mating grounding plates 110. Even after the integral molding of the mating grounding plates 1110 with the housing 90, each carrier C will not be separated from the mating grounding plates 110.

As shown in FIG. 1, each connecting member 120 connects and supports the plurality of mating connectors 3 via the mating grounding plates 110 respectively supported by the respective housing 90. The connecting members 120 are bent at a right angle so as to have their sheet surfaces perpendicular to the connector's widthwise direction. The joining sections 113 are disposed in the recess sections 94 of the housings 90 of the respective mating connectors 3.

As described above, the plurality of the mating connectors 3 are joined with the connecting members 120. Therefore, it is easier to maintain precision of physical relationship among the mating connectors 3, so that it is possible to securely connect the relay connector 1 to the mating connectors 3.

Moreover, each carrier C generally has a large width and great strength, so that it is suitable as the connecting member 120. In addition, it is possible to keep the carrier C without cutting away from the grounding plates 110 and discarding and to effectively use as the connecting member 120. Therefore, it is possible to restrain the manufacturing cost.

Furthermore, since the respective grounding plates are electrically connected by the connecting members 120, it is also possible to improve the grounding effect. Moreover, the connecting members 120 cover the side end surfaces of the mating connectors 3 by their sheet surfaces, so that it is also possible to use the connecting members 120 as shielding plates.

Referring now to FIGS. 1 and 2, procedure for fitting the relay connector 1 to the mating connectors 2 and 3 will be described. First, a plurality (five each in the embodiment) of the mating connectors 2 and 3 is attached to different circuit boards (not illustrated) by soldering. Thereafter, the mating connectors 3 are positioned so as to have the fitting wall sections 92 rise upward (as shown in FIG. 1). The lower receiving sections 12 of the respective intermediate connecting members 10 of the relay connector 1 are positioned so as to correspond to the fitting wall sections 92 of the mating connectors 3, and the relay connector 1 is placed above the mating connectors 3.

Then, moving the relay connector 1 downward, the respective intermediate connecting members 10 are fitted to the corresponding mating connectors 3 from thereabove. At this time, the fitting wall sections 92 of the mating connectors 3 enter the lower receiving sections 12 of the intermediate connecting members 10. Once the fitting between the relay connector 1 and the mating connectors 3 is completed, the lower contact sections 32A of the terminals 30 provided on the blades 20 of the intermediate connecting members 10 contact with certain contact pressure to the mating contact sections 101 of the mating terminals provided in the mating connectors 3.

More specifically, as shown in FIG. 16(A), the lower contact sections 21AS of the signal terminals 30S contact with the mating contact sections 101S of the mating signal terminals 100S. As shown in FIG. 16(B), the lower contact sections 32GS of the grounding terminals 30G contact with mating contact sections 101G of the mating grounding terminals 100G.

Thereafter, the mating connectors 2 are positioned so as to be turned upside down relative to the mating connectors 3. Then, the mating connectors 2 are fitted and connected to the relay connector 1 from thereabove. Since the procedure for fitting and connecting the mating connectors 2 is the same as the above-described procedure for fitting and connecting the mating connectors 3 to the relay connector 1, so that the explanation is omitted. As shown in FIG. 2, the mating connectors 2 and the mating connectors 3 are fitted and connected to the relay connector 1, and thereby the mating connectors 2 and the mating connectors 3, which correspond to each other, are electrically connected via the respective intermediate connecting members 10.

According to the first embodiment, in the inner grounding plates 50 and the outer grounding plates 60 provided in the blades 20 of the relay connector 1, the outer grounding plates 60 shield the range that corresponds to where the contact sections 31A and 32A of the terminals 30 are present from a side opposite the contact surfaces of the contact sections 31A and 32A.

In addition, for the mating connectors 2 and 3, the mating grounding terminals 110 shield the range that corresponds to where the mating contact sections 101 of the mating terminals 100 are present from a side opposite the contact surfaces of the mating contact sections 101.

Therefore, according to the first embodiment, in a state that the connectors are connected, the parts where the contact sections 31A and 32A and the mating contact sections 101 contact are shielded by the outer grounding plates 60 and the mating grounding plates 110 from both sides of the blades 20 in the sheet thickness direction (the shielding of the part where the relay connector 1 and the mating connectors 3 connect to each other is shown in FIGS. 16(A) and 16(B)). As a result, it is possible to securely transmit signals at the contacting parts without influence of noises from outside.

In addition, according to the first embodiment, the outer grounding plates 60 and the grounding terminals 30G are provided as separate members. The grounding plates 60 contact with the joining sections 33G of the grounding terminals 30G. In other words, it is not necessary to form the outer grounding plates 60 to include grounding contact sections having flexibility like conventional ones.

Therefore, upon designing the outer grounding plates 60, there is no restriction on the shapes of parts that correspond to the contact sections 31AS and 32AS of the signal terminals 30S, so that it is possible to freely design the shapes of the parts. As a result, it is possible to easily adjust impedance by designing the shapes of the parts that correspond to the contact sections 31AS and 32AS so as to be able to obtain satisfactory matching of impedance at the parts where the signal terminals 30S and the mating signal terminals 100S contact (e.g., the above-described shapes of the protruding pad-like sections 66.

Next, referring to FIG. 11(B), floating operation will be described, when there is displacement between the mating connectors 2 and 3 in the arrangement direction of the intermediate connecting members 10 (a left-and-right direction in FIG. 11(B)).

In the embodiment, a case is described when displacement occurs among the mating connectors 2 and 3 by external force unexpectedly applied on the mating connectors 2 and 3. Here, the external force is applied on the mating connectors 2 and 3 in opposite directions to each other in the arrangement direction in a state that the connectors are fitted. In the example of FIG. 11(B), the displacement is supposed to occur by relative rightward movement of the mating connectors 3 and relative leftward movement of the mating connectors 2 (See the respective arrows in FIG. 11(B)).

Once the displacement among the mating connectors 2 and 3 occurs in the arrangement direction, within the range of the spaces between the inner wall surfaces of the holes to be supported 77A and 77B of the intermediate connecting members 10 and the supporting members 82 and 83 of the support members 80, the intermediate connecting members 10 tilt according to the displacements. At this time, the intermediate connecting members 10 tilt while keeping the state that the supporting members 82 and 83 stably support the holes to be supported 77A and 77B.

According to the first embodiment, the intermediate connecting members 10 are not supported by being housed in the slit-like housing groove portions formed in housing as in a conventional relay connector, but are supported by the flat support members 80 provided on the both side surfaces of the intermediate connecting members 10. Therefore, it is not necessary to provide a dividing wall in the housing between the intermediate connecting members as in a conventional relay connector, so that it is possible to provide the relay connector bodies 10 close to each other.

In addition, it is also possible to reduce the size of the relay connector 1 in the arrangement direction. Moreover, it is also not necessary to provide an end wall on the housing outside of the arrangement range of the intermediate connecting members 10, so that it is possible to further reduce the size of the relay connector 1 in the arrangement direction.

Furthermore, according to the first embodiment, since the support members 80 are flat members, it is not necessary to provide housing groove portions or receiving groove portions, which do not have so large width, in a large number and close to each other. In addition, it is not necessary to form the protruding portions in the receiving groove portions. Accordingly, the support members 80 don't have to have complicated shapes. Therefore, it is easily produce the support members 80.

According to the first embodiment, there are two blades 20 provided in each intermediate connecting member 10. However, the number of the blades 20 is not limited to this. For example, it is possible to provide one blade 20 in each intermediate connecting member 10. In this case, correspondingly, the mating connectors 2 and 3 only have the mating terminals 100 and the mating grounding plates 110, which correspond to the one blade 20.

According to the first embodiment, the two mating connecting bodies are mating connectors. Alternatively, one of the mating connecting bodies can be a circuit board. In this case, the terminals of the intermediate connecting member include connecting sections at ends thereof to be connected to the circuit board. The connecting sections are connected to the circuit board by soldering.

Second Embodiment

Figure 17:
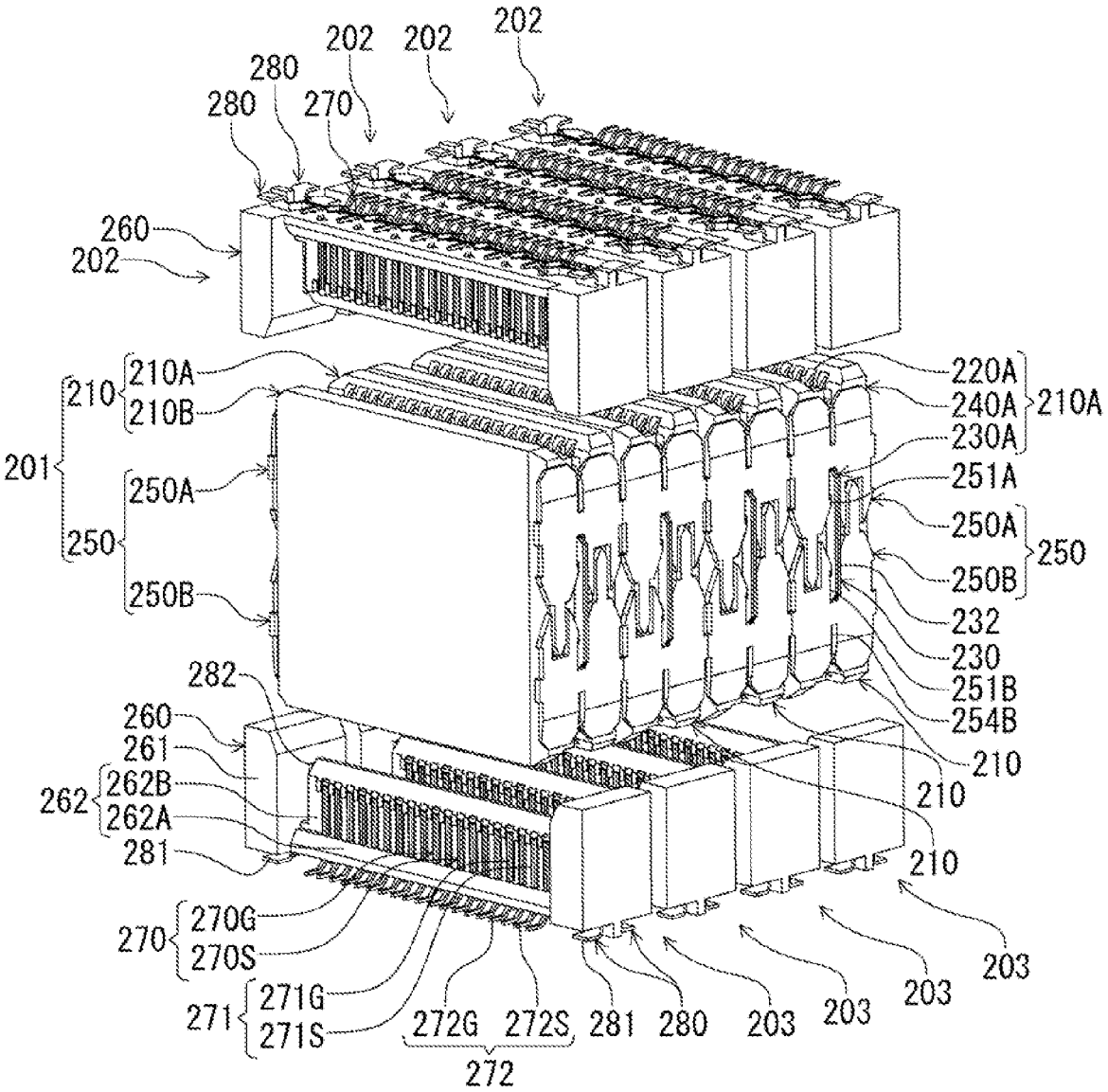
FIG. 17 is a perspective view showing an intermediate electrical connector according to a second embodiment of the invention, which shows with mating connector thereof before fitting thereto.
Figure 18:
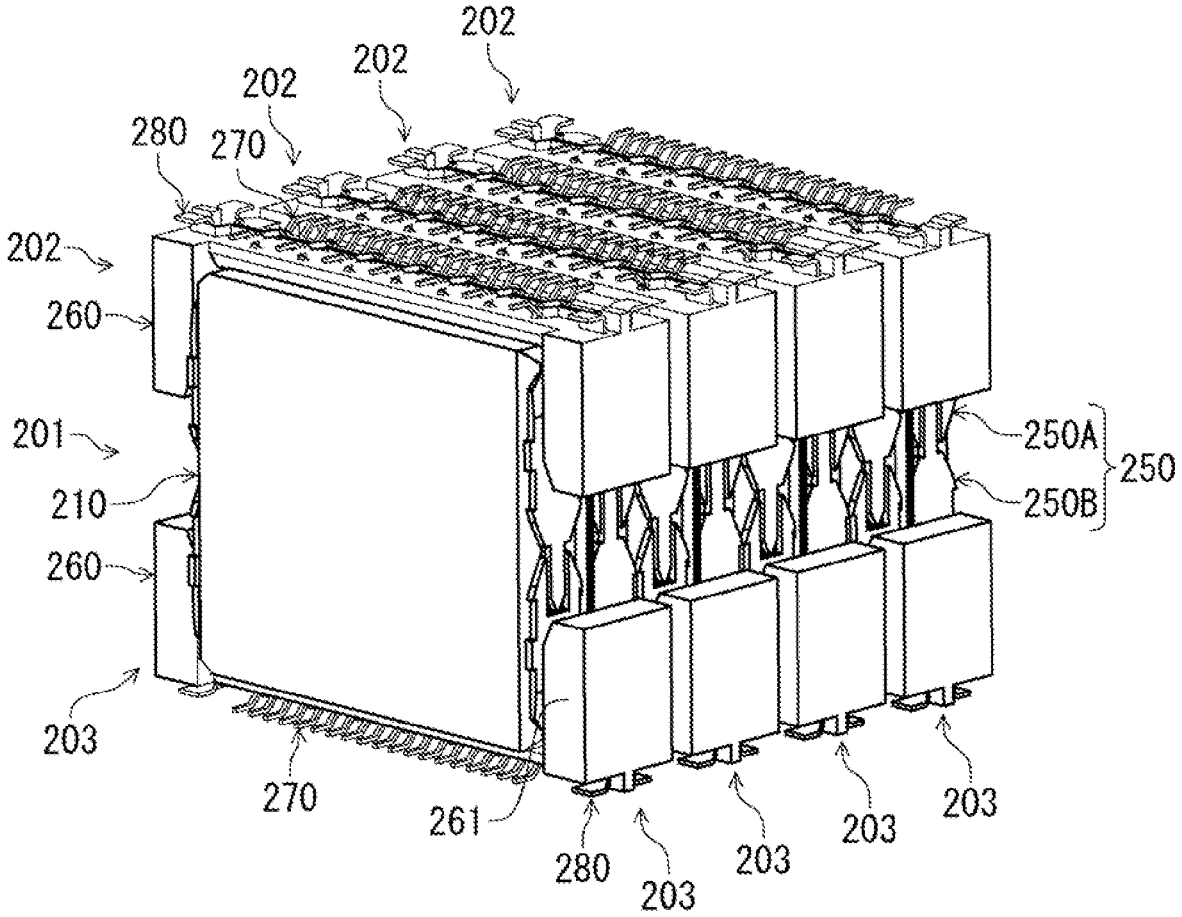
FIG. 18 is a perspective view of the intermediate electrical connector of FIG. 17 and the mating connectors in a state that the mating connectors are fitted to the intermediate electrical connector.

A second embodiment of the present invention will be explained next. FIG. 17 is a perspective view showing the intermediate electrical connector according to the second embodiment of the invention with a mating connector thereof, in a state before fitting the connectors. In addition, FIG. 18 is a perspective view showing a state that the intermediate electrical connector and the mating connectors of FIG. 17 are fitted.

In the second embodiment, to the intermediate electrical connector 201 (hereinafter simply referred to as "relay connector 201") according to the embodiment, a plurality of mating connecting bodies, mating connectors 202 and 203, are connected from thereabove and from thereunder, respectively. Accordingly the relay connector 201 relays and connects between the both connectors 202 and 203. The mating connectors 202 and 203 have the same shape, and are electrical connectors for using on circuit boards. The mating connectors 202 and 203 are connected to different circuit boards (not illustrated).

As shown in FIG. 17, according to the second embodiment, the relay connector 201 includes four intermediate connecting members 210, and connects between four mating connectors 202 disposed on one circuit board and four mating connectors 203 disposed on the other circuit board.

The relay connector 201 shown in FIG. 17 includes a plurality of intermediate connecting members 210 and two support members 250. The plurality of intermediate connecting members 210 are connected to the mating connectors 202 and 203. Those support members 250 arrange the plurality of intermediate connecting members 210 and support them together. The supporting members 210 are made of sheet metal.

According to the second embodiment, there are provided four intermediate connecting members 210, so as to correspond to the mating connectors 202 and 203. Those four intermediate connecting members 210 are arranged at constant intervals being close to each other in a direction horizontal to a surface of the circuit boards.

Each intermediate connecting member 210 includes two blades 210A and 210B having the same shape. The two blades are disposed facing each other being symmetrical in about arrangement direction of the intermediate connecting members 210. Since the blades 210A and 210B have the same configuration, only the configuration of the blade 210A will be described below. Explanation of the blades 210B will be omitted, affixing "B" in place of "A" in reference numerals of the blade 210A.

Each blade 210A includes a plurality of terminals 220A, a grounding plate 230A, and a substrate 240A. The plurality of terminals 220A is arranged at constant intervals in a connector's widthwise direction that is perpendicular to the arrangement direction of the intermediate connecting members 210. The grounding plate 230A is disposed having sheet surfaces thereof be perpendicular to the arrangement direction. The substrate 240A is made of resin and holds the plurality of terminals 220A and the grounding plate 230A by integral molding. Hereunder, a side of surface that faces the blade 210B is referred to as "inner side" and a side opposite thereto is referred to as "outer side".

The terminals 220A are used as signal terminals 220AS or grounding terminals 220AG. In each blade 210A, the terminals 220A are disposed such that the grounding terminal 220AG is disposed between two signal terminals 220AS that are adjacent to each other (See FIG. 19(C)). Hereunder, when it is not necessary to specially distinguish between the signal terminals 220AS and the grounding terminals 220AG, those terminals are simply referred to as terminals 220A.

Each terminal 220A is made by bending strip-like metal piece extending in a connector's fitting direction, i.e., an up-and-down direction. The terminals 220A are bent so as to protrude inward at their upper end side and lower end side. Each terminal 220A has an upper contact section 221 and a lower contact section 222 for the terminals 220A to contact with terminals (mating terminals) of the mating connectors 202 and 203 (See upper contact sections 221AG and lower contact sections 222AG of the grounding terminals 220AG in FIG. 19(B)).

Each grounding plate 230 is made by bending a sheet metal piece in a sheet thickness direction thereof. Each grounding plate 230 includes a main body (not illustrated), side plate sections 231A, and flat supported portions 232A. The main body of each grounding plate 230 extends in the range of terminal arrangement and outside than the plurality of terminals 220 in the connector's widthwise direction.

The side plate sections 231A are bent inward in a thickness direction of the intermediate connecting member 210 at the both side edges (edges that extend in the up-and-down direction) of the main body of the grounding plate 230 in the connector's widthwise direction. The flat supported portions 232A are provided as supported portions and formed being bent perpendicularly outward in the connector's widthwise direction at end edges (edges that extend in the up-and-down direction) of the side plate sections 231A.

The flat supported portions 232A protrude outward in the connector's widthwise direction from side end surfaces of the substrate 240, and extend in the direction in the middle in the up-and-down direction of the blade 210A. Each flat supported portion 232A has a sheet surface perpendicular to the arrangement direction of the intermediate connecting members 210.

Figure 19:
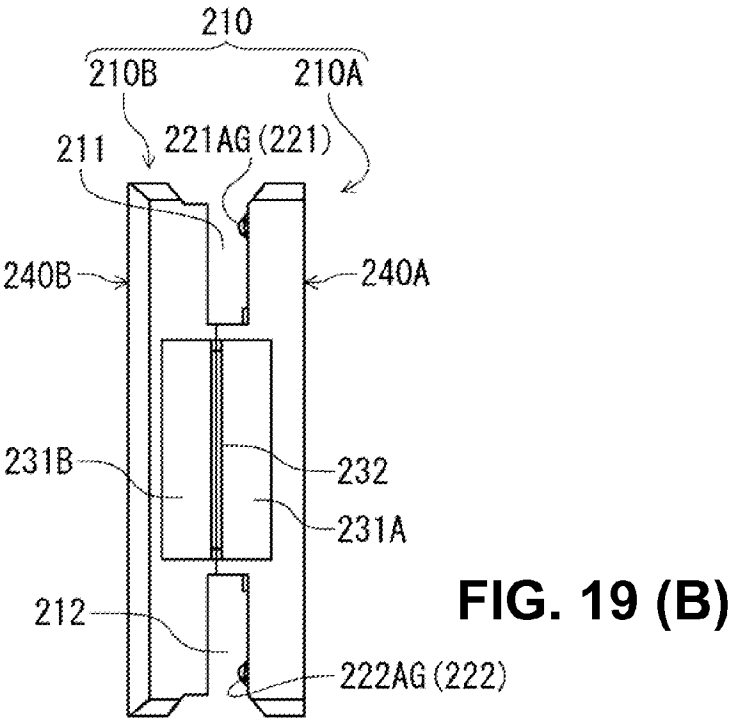
Figure 19:
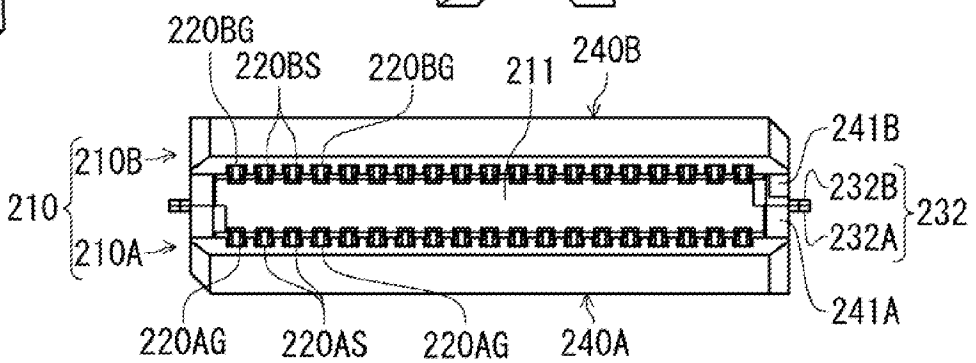
Figure 19:
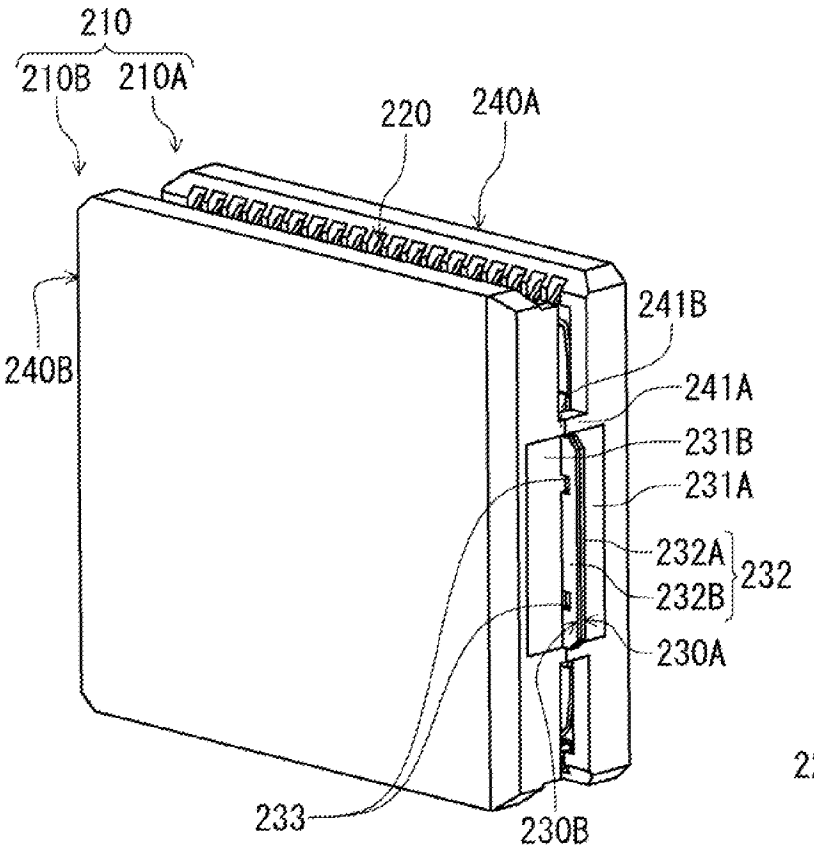

In addition, each flat supported portion 232A has holes (See holes 233 in FIG. 19(A)). The holes 233 are provided near upper end and near lower end of the flat supported portion 232A, and penetrate the flat supported portion 232A in a sheet thickness direction thereof.

The substrate 240A has protruding portions 241A. Those protruding portions 241A protrude inward in the thickness direction of the intermediate connecting member 210 from both side of the substrate 240A in the connector's widthwise direction. The protruding portions 241A are formed in the range where the flat sections 232A of the grounding plate 230A are present, which are in the middle in the up-and-down direction of the substrate 240A. The protruding portions 241A protrude to the same positions as those of the flat supported portions 232A in the arrangement direction.

As shown in FIGS. 19(A) through 19(C), in each intermediate connecting member 210, the protruding portions 241A of the blade 210A and the protruding portions 241B of the blade 210B abut each other, and inner surfaces of the blade 210A and the blade 210B face each other at a specified distance away from each other. In addition, the flat supported portions 232A and 232B of the blades 210A and 210B contact to each other by their surfaces and form one flat supported portion.

Moreover, the holes on the upper end sides and the holes on the lower end sides of the flat supported portions 232A and 232B are aligned so as to have the holes' positions match each other and respectively form holes 233. On an upper part of each intermediate connecting member 210 having the above-described configuration, there is formed space opened upward between the blades 210A and 210B. The space serves as an upper receiving section 211, and receives from thereabove a fitting wall section 262B of the mating connector 202, which will be described later.

On the other hand, on a lower part of each intermediate connecting member 210, there is space opened downward between the blades 210A and 210B. The space serves as a lower receiving section 212 and receives from thereunder a fitting wall section 262B of the mating connector 203, which will be described later.

The blades 210A and 210B of each intermediate connecting member 210 are not fixed to each other. As will be described later, the flat supported portions 232 of the grounding plates 230A and 230B are supported by support groove portions 251A and 251B of the support members 250 by being housed therein, and thereby the blades 210A and 210B can remain in the state of facing each other.

Each support member 250 is made by punching a sheet metal piece while keeping its flat surface. As shown in FIG. 17, each support member 250 extends in the arrangement direction of the intermediate connecting members 210 and in the up-and-down direction, and faces a side end surfaces of the intermediate connecting members 210 over the arrangement range of the intermediate connecting members 210 in the arrangement direction. In addition, each support member 250 is split in the up-and-down direction and is composed of an upper member 250A and a lower member 250B.

The upper member 250A faces an upper region of side end surfaces of the intermediate connecting members 210. The lower member faces a lower region of the side end surfaces of the intermediate connecting members 210. According to the second embodiment, one upper member 250A and one lower member 250B together cover generally the whole area of one side end surfaces of the intermediate connecting members 210 (See also FIG. 21(B)). The support members 250 also serve as shielding plates.

Moreover, the upper members 250A and the lower members 250B can move relative to each other in the arrangement direction in a specified range in the arrangement direction.

The upper members 250A and the lower members 250B are formed in the same shape but being turned upside down. Hereunder, referring to FIG. 22, the configuration of the upper member 250A will be described. Explanation of the lower members 250B will be omitted affixing "B" in place of "A" in reference numerals of the respective parts of the upper members 250A.

Figure 22:
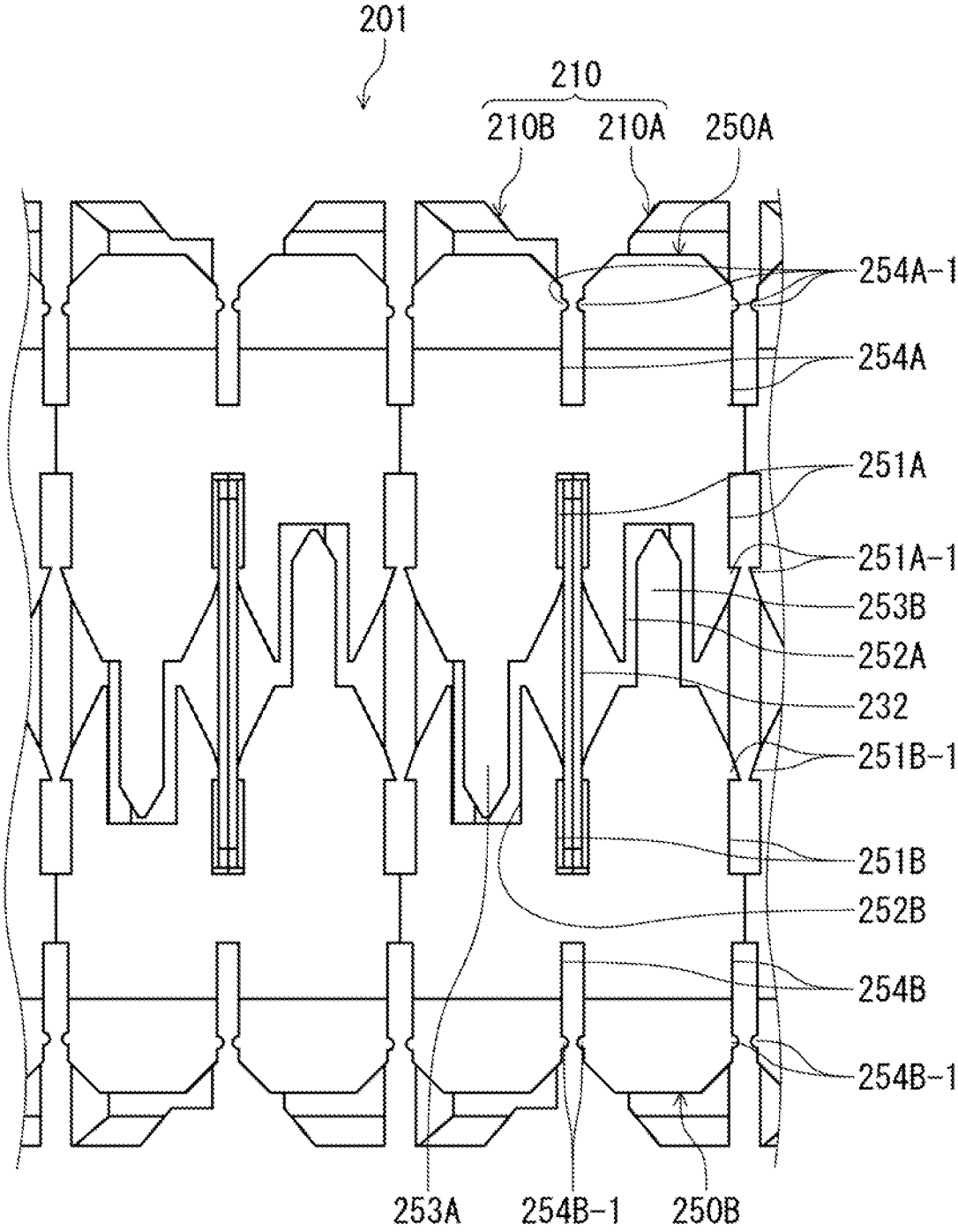
FIG. 22 is a partial enlarged view of the intermediate electrical connector.

As shown in FIG. 22, on a lower edge of each upper member 250A, there are support groove portions 251A, regulating recessed portions 252A, and regulating protruding portions 253A, which are formed by punch work. The support groove portions 251A serve as supporting members to house the flat supported portions 232 of the intermediate connecting members 210 and support them in the arrangement direction of the intermediate connecting members 210.

The regulating recessed portions 252A receive regulating protruding portions 253B of the lower member 250B and restrict each other with the regulating protruding portions 253B in the arrangement direction of the intermediate connecting members 210 (in a left-and-right direction). The regulating protruding portions 253A are to be put in the regulating recessed portions 252B and restrict each other with the regulating recessed portions 252B in the arrangement direction.

Moreover, at the same positions as those of the support groove portions 251A in the arrangement direction, there are fitting groove portion sections 254A for receiving from thereabove fitting plate sections of the mating connectors 202, which are formed by punch work and will be described later.

As shown in FIG. 22, the support groove portions 251A, regulating recessed portions 252A, regulating protruding portions 253A, and fitting groove portions 254A are formed so as to repeat arrangement of specific order and interval in the arrangement direction.

The support groove portions 251A are formed as slit-like groove portions, which extend and open downward, between the regulating recessed portions 252A and the regulating protruding portions 253A in the arrangement direction. Each support groove portions 251A has a larger groove portion width than sheet thickness of each flat supported portion 232 of the intermediate connecting members 210.

Therefore, as shown in FIG. 22, in a state the flat supported portions 232 are housed in the support groove portions 251A, there are formed gaps in the arrangement direction between the facing edges and the flat supported portions 232 of the intermediate connecting members 210. Here, the facing edges extend in the up-and-down direction and form the support groove portion 251A. Each facing edge has a support protruding portion 251A-1 in the middle in the up-and-down direction. The support protruding portions 251A-1 support the flat supported portions 232.

Moreover, the facing edges are formed as slanted edges such that lower parts thereof than the support protruding portions 251A-1 are away from each other as it goes downward. In other words, the support groove portions 251A are formed to be opened downward. As will be described later, upon receiving the flat supported portions 232 of the intermediate connecting members 210 from thereunder, the slanted edges guide the flat supported portions 232 into the support groove portions 251A-1.

Furthermore, according to the second embodiment, the support groove portions 251A have the same dimension as the thickness of the blades 210A and 210B in the arrangement direction of the intermediate connecting members 210. In short, the support groove portions 251A are formed at intervals that are half of the thickness of one intermediate connecting member 210. Therefore, as in the second embodiment, when the plurality of intermediate connecting members 210 is arranged at constant intervals while being close to each other, the flat supported portions 232 of the intermediate connecting members 210 will be housed in every other support groove portions 251A.

The regulating recessed portions 252A are concave sections being recessed between the support groove portions 251A and the regulating protruding portions 253A in the arrangement direction so as to extend and open downward. The regulating recessed portions 252A have their lower ends disposed at the same levels as lower ends of the support groove portions 251A.

Moreover, the regulating recessed portions 252A have a larger groove portion depth (a dimension in the left-and-right direction in FIG. 22) than the regulating protruding portions 253B of the lower member 250B. Therefore, as shown in FIG. 22, when the regulating protruding portions 253B are housed in the regulating recessed portions 252A, there will be formed gaps between the facing edges and the regulating protruding portions 253B. Here, the facing edges extend in the up-and-down direction and form the regulating recessed portions 252A. The regulating recessed portions 252A extend in the up-and-down direction, with the facing edges are horizontal to each other without slanting. The regulating recessed portions 252A have the same groove portion width over the whole area in the up-and-down direction.

The regulating protruding portions 253A are formed between the support groove portions 251A that are adjacent to each other in the arrangement direction. The regulating protruding portions 253A protrude downward from the same position as those of lower ends of the support groove portions 251A and the regulating recessed portions 252A in the up-and-down direction.

As shown in FIG. 22, the regulating protruding portions 253A have smaller width than the groove portion width of the regulating recessed portions of the lower member 250B. When the regulating recessed portions 252B house the regulating protruding portions 253A therein, there will be formed gaps between the facing side edges of the regulating recessed portion 252B and the regulating protruding portion 253A. Here, the side facing edges extend in the up-and-down direction and form the regulating recessed portions 252B.

Moreover, the facing side edges of the regulating protruding portions 253A extend in the up-and-down direction, being horizontal to each other without tilting, and then as it goes downward, the facing side edges of the regulating protruding portions 253A are tilted at their lower end side. The lower end parts of the regulating protruding portions 253A work as guide sections, when the regulating protruding portions 253A enter the regulating recessed portions 252B from thereabove.

As shown in FIG. 22, the fitting groove portions 254A are formed as slit-like groove portions opened upward. The fitting groove portions 254A have a larger groove portion width than the sheet thickness of the flat fitting sections 282 of the mating connectors 202. When the fitting groves 254A house the flat fitting sections 282 therein, there will be gaps formed between the facing edges of the fitting groove portions 254A (edges that extend in the up-and-down direction) and the flat fitting sections 282.

Each of the facing edges has a support protruding portion 254A-1 that protrudes therefrom near the upper end thereof for supporting the flat fitting section 282. In addition, the facing edges have slanting edges above the support protruding portions 254A-1. The slanting edges are formed to be away from each other as it goes upward. In other words, the fitting groove portions 254A are formed being widened upward.

As will be described later, upon receiving the flat fitting sections 282 from thereabove, the fitting groove portions 254A guide the slanting edges into the fitting groove portions 254A. Here, the fitting groove portions 254B of the lower members 250B have the shape of the fitting groove portions 254A of the upper members 250A, but being turned upside down. The fitting groove portions 254B receive the flat fitting sections 282 of the mating connectors 203 from thereunder.

Each support member 250 is formed such that the support groove portions 251A and 251B, regulating recessed portions 252A and 252B, regulating protruding portions 253A and 253B, and the fitting groove portions 254A and 254B are repetitively arranged in a specified order at specified intervals in the arrangement direction of the intermediate connecting members 210. Therefore, sheet metal piece is prepared, in which the support groove portions 251A and 251B, the regulating recessed portions 252A and 252B, the regulating protruding portions 253A and 253B, and the fitting groove portions 254A and 254B are formed respectively. Then, cutting the sheet metal piece into suitable lengths for the number of the intermediate connecting members 210, it is possible to obtain the upper members 250A and the lower members 250B of the support members 250.

As a result, even when the number of the intermediate connecting members 210 and/or the intervals between the intermediate connecting members increase(s) or decrease(s), as long as the sheet metal piece is cut into suitable lengths according to the number or intervals of the intermediate connecting members 210, it is possible to make a desired length of support members 250 from one type of sheet metal member. Therefore, it is possible to restrain the manufacturing cost.

In addition, the upper members 250A and the lower member 250B have the same shape. Therefore, it is possible to make the both upper members 250A and 250B from one type of sheet metal piece, and it is possible to further restrain the manufacturing cost. Moreover, the support members 250 are made of a sheet metal piece having sheet surfaces that faces the both side end surface of the intermediate connecting members 210, so that it is easy to process than when the supporting members having housing groove portions to house the intermediate connecting members from electrically insulating materials, or the like. Therefore, it is possible to easily make the supporting members.

Furthermore, according to the second embodiment, the flat support members 250 support the intermediate connecting members 210 at the both side surfaces of the intermediate connecting members 210. Therefore, similarly to the first embodiment, it is not necessary to provide a dividing wall or an end wall on the housing to support the intermediate connecting member as in conventional technique, and it is possible to reduce the size of the intermediate connecting members in the arrangement direction of the intermediate connecting members 210.

In addition, according to the second embodiment, the grounding plates 230 have the supported portions 231 and the supported portions 231 are supported with the support protruding portions 251A-1 and 251B-1 of the support members 250. Therefore, it is possible to improve the grounding effect.

Figure 20:
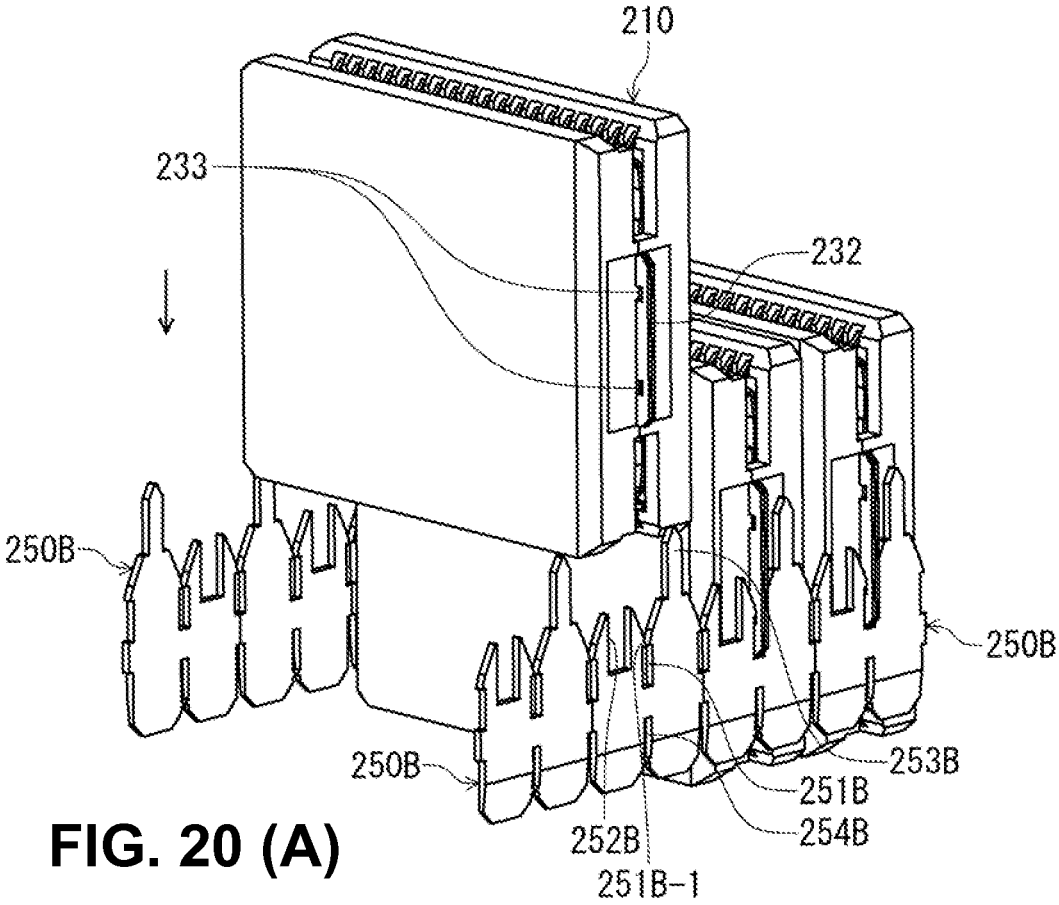
Figure 20:
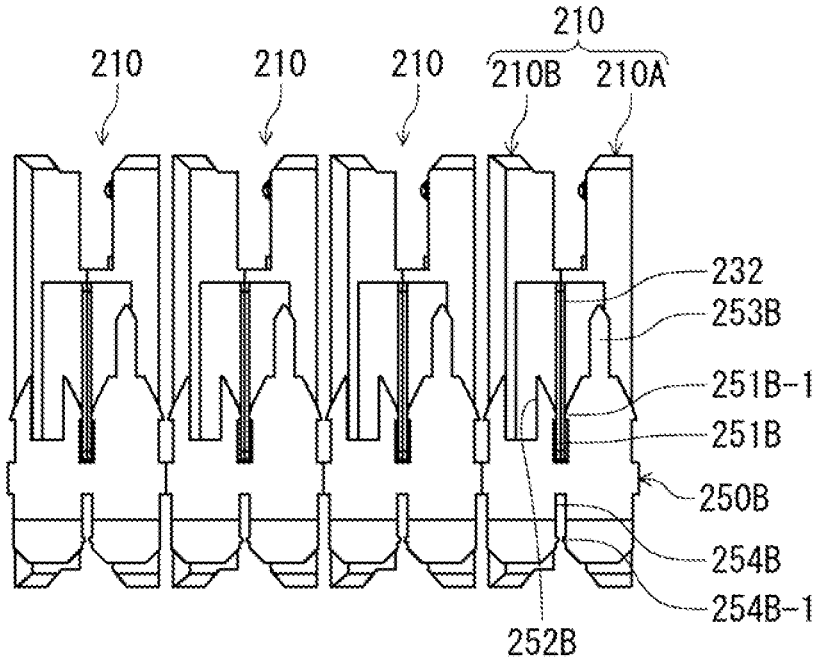
Figure 21:
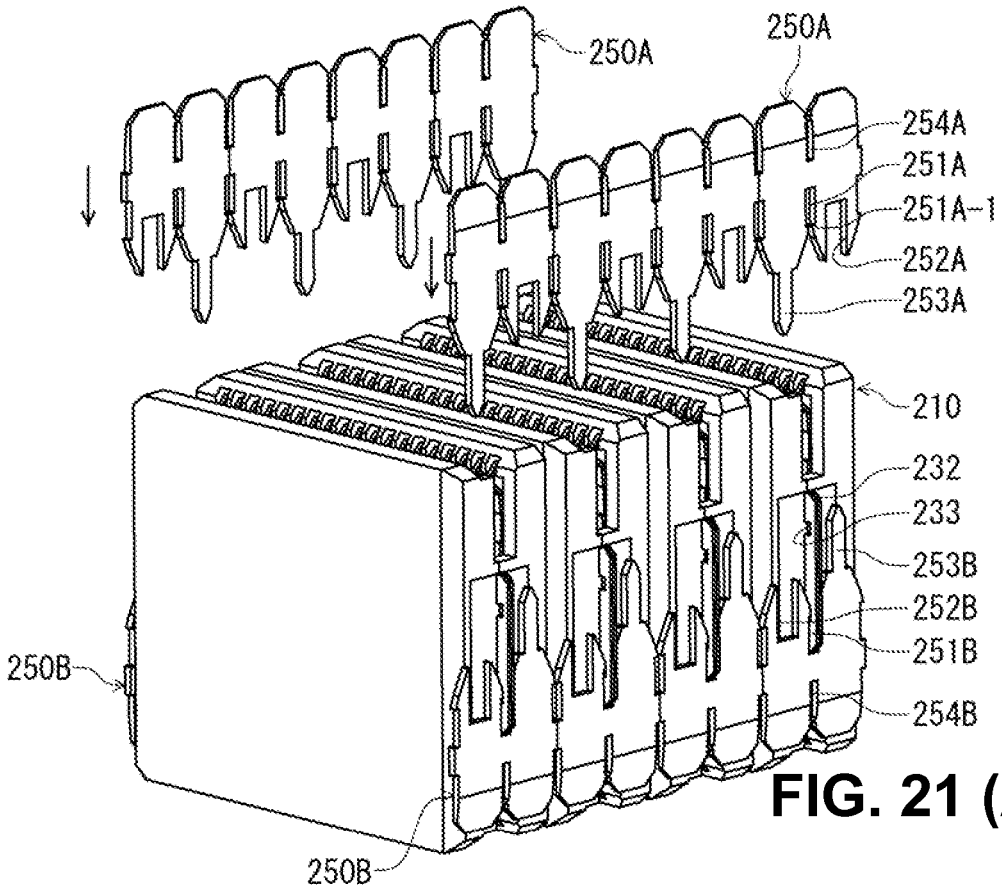
Figure 21:
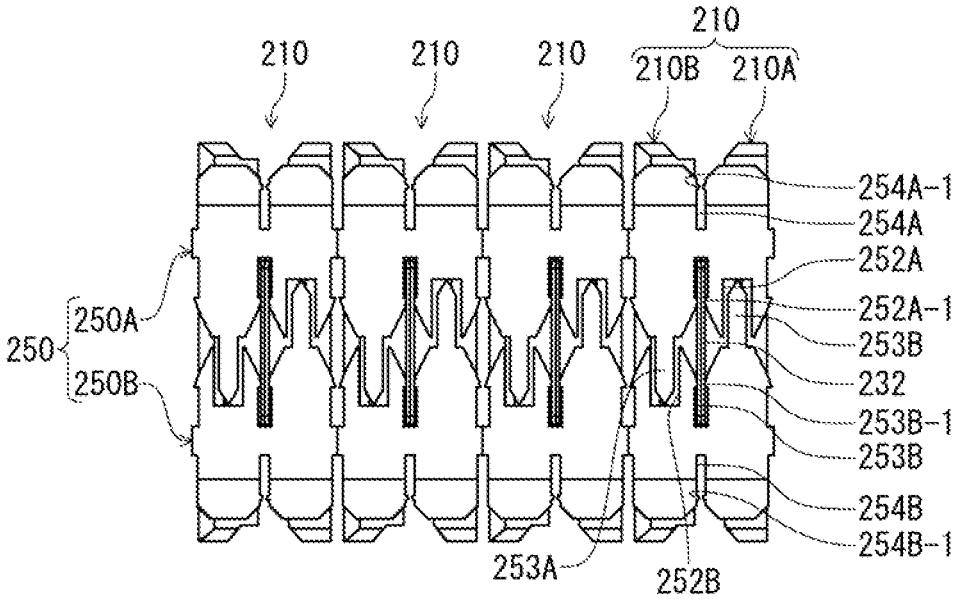

Next, referring to FIGS. 20 and 21, the assembling process of the relay connector 201 will be described. First, the above-described sheet metal pieces are cut into lengths suitable for the number of the intermediate connecting members 210 (four in the second embodiment). As a result, two upper members 250A and two lower members 250B are prepared. Next, as shown in FIG. 20(A), while the two lower members 250B are put upright and face each other in the connector's widthwise direction, the intermediate connecting members 210 are attached to the lower members 250B one by one from thereabove (See the arrow in FIG. 20(A)).

More specifically, the flat supported portions 232 of the intermediate connecting members 210 are inserted in the support groove portions 251B of the lower members 250B from thereabove. Once insertion of the flat supported portions 232 to the support groove portions 251B is completed, the support protruding portions 251B-1 of the support groove portions 251B enter the holes 233 provided at their lower side of the flat supported portions 232.

As a result, the flat supported portions 232 are supported in the arrangement direction of the intermediate connecting members 210, and are supported in a state of being capable of tilting around the support protruding portions 251B-1. Moreover, engagement between the support protruding portions 251B-1 and the inner edges of the holes 233, it is possible to prevent coming off of the flat supported portions 232 upward.

Thereafter, as shown in FIG. 20(B), to the four intermediate connecting members 210 that are attached to the lower members 250B, two upper members 250A are attached from thereabove as shown in FIG. 21(A) (See the arrow in FIG. 21(A)). More specifically, the flat supported portions 232 of the intermediate connecting members 210 are inserted in the support groove portions 251A of the upper members 250A from thereunder. At the same time, the regulating protruding portions 253B of the lower members 250B enter the regulating recessed portions 252A of the upper members 250A from thereunder. The regulating protruding portions 253A of the upper members 250A enter the regulating recessed portions 252B of the upper members 250B from thereabove (FIG. 21(B)).

As a result, the regulating protruding portions 253A and 253B are positioned so as to respectively engage with the regulating recessed portions 252B and 252A in the regulating protruding portions 252B and 252A. As a result, the flat supported portions 232 are supported in the arrangement direction of the intermediate connecting members 210, and are supported in a state of being capable of tilting around the support protruding portions 251A-1.

Moreover, with the engagement between the support protruding portions 251A-1 and the inner edges of the holes 233, it is possible to prevent coming off of the flat supported portions 232 downward. Accordingly, the two upper members 250A and the two lower members 250 are attached, and the assembling of the relay connector 201 is completed.

Next, referring to FIG. 17, the configurations of the mating connectors 202 and 203 will be described. The mating connectors 202 and 203 have the identical configuration. Therefore, hereunder, explanation is mainly provided for the configuration of the mating connectors 203. Explanation of the mating connectors 202 will be omitted by affixing the same reference numerals as those of the mating connectors 203.

Each mating connector 203 includes a housing 260, a plurality of terminals 270 (hereinafter referred to as "mating terminals 270"), and two mating grounding plates 280. The housing 260 is made of resin and extends having the connector's widthwise direction (the same direction as the connector's widthwise direction of the relay connector 201) as a longitudinal direction thereof. The plurality of terminals 270 is arranged and held in the connector's widthwise direction by the housing 260. The grounding plates 280 are held in the housing 260.

As shown in FIG. 17, each housing 260 includes two end walls 261, and a joining wall section 262. The two end walls 261 are provided at both ends of the housing 260 in the connector's widthwise direction. The joining wall section 262 extends in the connector's widthwise direction and joins the two end walls 261. The joining wall sections 262 have generally the same dimension as the relay connector 201 in the connector's widthwise direction. In short, the two end walls 261 are provided outside the range of the relay connector 201 in the connector's widthwise direction (See also FIG. 18).

Each joining wall section 262 includes a basal section 262A and a fitting wall section 262B. The basal section 262A joins lower parts of the two end walls 261. The fitting wall section 262B extends over the arrangement range of the terminals 270 in the connector's widthwise direction. The fitting wall section 262B extends upward from the basal section 262A. The fitting wall section 262B has a flat shape having sheet surfaces perpendicular to the arrangement direction of the intermediate connecting members 210.

The fitting wall sections 2622B are formed as fitting section to fit to the lower receiving sections 212 of the intermediate connecting members 210. The joining wall sections 262 are provided having their both ends in the connector's widthwise direction be at slightly larger intervals than the sheet thickness of the support members 250 between the inner surfaces of the end wall sections 261. As a result, between the joining walls 262 and the end walls 261, the fitting plate sections 282 of the mating grounding plates 280 are exposed.

The mating terminals 270 are made by bending metal strip-like piece in its sheet thickness direction. The mating terminals 270 are arranged and held in the joining wall sections 262 of the housings 260 along the connector's widthwise direction, for example by pressing therein.

The plurality of the mating terminals 270 is used as signal terminals 270S (hereinafter referred to as "mating signal terminals 270S") or grounding terminals 270G (hereinafter referred to as "mating grounding terminals 270G"). According to the second embodiment, the mating terminals 270 are arranged corresponding to the arrangement of the signal terminals 220AS and 220BS and the grounding terminals 220AG and 220BG provided in the blades 210A and 210B of each intermediate connecting member 210.

More specifically, the mating terminals 270 are arranged such that each mating grounding terminal 270G is placed between two mating signal terminals 270S that are adjacent to each other. Hereunder, as long as it is not especially necessary to distinguish between the mating signal terminals 270S and the mating grounding terminals 270G, those terminals 270S and 270G are simply referred to as "mating terminals 270" and the configuration of the mating terminals 270 will be described below.

The mating terminals 270 are provided on the both sheet surfaces of the fitting wall section 262B of each housing 260. The mating terminals 270 are provided in two rows symmetrical about the fitting wall section 262B in the sheet thickness direction of the fitting wall section 262B. Each mating terminal 270 includes a contact arm 271 and a connecting section 272.

The contact arms 271 extend in the up-and-down direction along the sheet surface of the fitting wall section 262B. The connecting sections are provided at lower ends of the mating terminals 270 being bent to and extending in a direction to be away from the fitting wall section 262B in the arrangement direction. Each contact arm 271 contacts with a lower contact section 222 of a terminal 220 of the relay connector 201 at a sheet surface exposed from the fitting wall section 262B.

More specifically, the contact arms 271S of the mating signal terminals 270 contact with the lower contact sections 222 of the signal terminals 220AS and 220BS. The contact arms 271G of the mating grounding terminals 270G contact with the lower contact sections 222 of the grounding terminals 220AG and 220BG. Moreover, the connecting sections 272 have their lower surfaces disposed at the same height levels as the corresponding circuit units of the circuit board (not illustrated), and can be connected to the corresponding circuit units by soldering.

More specifically, the connecting sections 272S of the mating signal terminals 270S connect to a signal circuit unit and the connecting sections 272G of the mating grounding terminals 270G connect to the grounding circuit unit.

The mating grounding plates 280 are made by applying punching work and bending work on a sheet metal piece. Each mating grounding plate 280 includes a main body (not illustrated) and a grounding leg 281. The main body of each mating grounding plate 280 has a sheet surface thereof perpendicular to the arrangement direction of the intermediate connecting members 10 and extends over generally the whole area where the mating connector 203 is present in the connector's widthwise direction. The grounding legs 281 extend downward from lower edges of the both end sections of the main body in the connector's widthwise direction, and are bent in the arrangement direction.

The main bodies extend in the connector's width direction at a center of the fitting wall sections 262B of the housing 260 in the arrangement direction, that is, between the rows of the mating terminals 270. The parts exposed in the space between the fitting wall section 262B and the end wall 261 are formed as fitting flat sections 282 to be housed in the fitting groove portions 254B of the lower members 250B of the support members 250. Each fitting plate 282 includes a hole (not illustrated) penetrating in the sheet thickness direction.

As will be described, while the mating connectors 203 are fitted in the relay connector 201, the support protruding portions 254B-1 of the fitting groove portions 254B enter the holes. In addition, lower ends of the grounding legs 281 are disposed at the same height levels as the connecting sections 272 of the mating terminals 270, and connect to corresponding grounding circuit units (not illustrated) of the circuit board by soldering.

According to the second embodiment, the two mating grounding plates 280 are provided so as to be symmetrical about the fitting wall section 262B in the arrangement direction (wall thickness direction of the fitting wall section 262B). In other words, the two mating grounding plates 280 are provided such that the grounding legs 281 thereof extend in directions opposite to each other. The mating grounding plates 280 are held, for example, by housing 260.

Next, referring to FIGS. 17 and 18, operation of fitting the relay connector 201 to the mating connectors 202 and 203 is described. First, the plurality (four in the second embodiment) of mating connectors 202 and 203 are attached to connect by soldering to different circuit boards (not illustrated) respectively. Thereafter, the mating connectors 203 are orientated such that the fitting wall sections 262B thereof extend upward (as shown in FIG. 17). Then, having the lower receiving sections 212 of the respective intermediate connecting members 210 of the relay connector 201 correspond to the respective fitting wall sections 262B of the mating connectors 203, the relay connector 201 is placed above the mating connectors 203.

Thereafter, moving the relay connector 201 downward, the connecting bodies 210 are fitted to their respective mating connectors 203 from thereabove. At this time, the fitting wall sections 262B of the mating connectors 203 enter the lower receiving sections 212 of the intermediate connecting members 210.

At the same time, the flat fitting sections 282 enter the fitting groove portions 254B of the lower members 250B of the intermediate connecting members 210 from thereunder. Once the fitting of the relay connector 201 to the mating connectors 203 is completed, the lower contact sections 222 of the terminals 220 provided in the blades 210A and 210B of the intermediate connecting members 210 contact with the contact arms 271 of the mating terminals 270 provided in the mating connectors 203 at certain contact pressure and electrically connect thereto.

More specifically, the signal terminals 220AS and 220BS contact with the mating signal terminals 270S, and the grounding terminals 220AG and 220BG contact with the mating grounding terminals 270G. Moreover, the support protruding portions 254B-1 of the fitting groove portions 254B enter the holes of the flat fitting sections 282 and support the fitting flat sections 282 in their sheet thickness direction.

At this time, the support protruding portions 254B-1 engage with the inner edges of the holes, and thereby it is possible to prevent the relay connector 201 from coming off from the mating connectors 203.

Next, the mating connectors 202 are orientated so as to be turned upside down relative to the mating connector 203 (as shown in FIG. 17), and then the mating connectors 202 are fitted and connected to the relay connector 201 from thereabove. The procedure for fitting and connecting the mating connectors 202 is the same as that of the mating connectors 203, so that explanation will be omitted.

Then, as shown in FIG. 18, the mating connectors 202 and the mating connectors 203 are connected to the relay connector 201, and thereby the mating connectors 202 and the mating connectors 203, which correspond to each other, are electrically connected.

Figure 23:
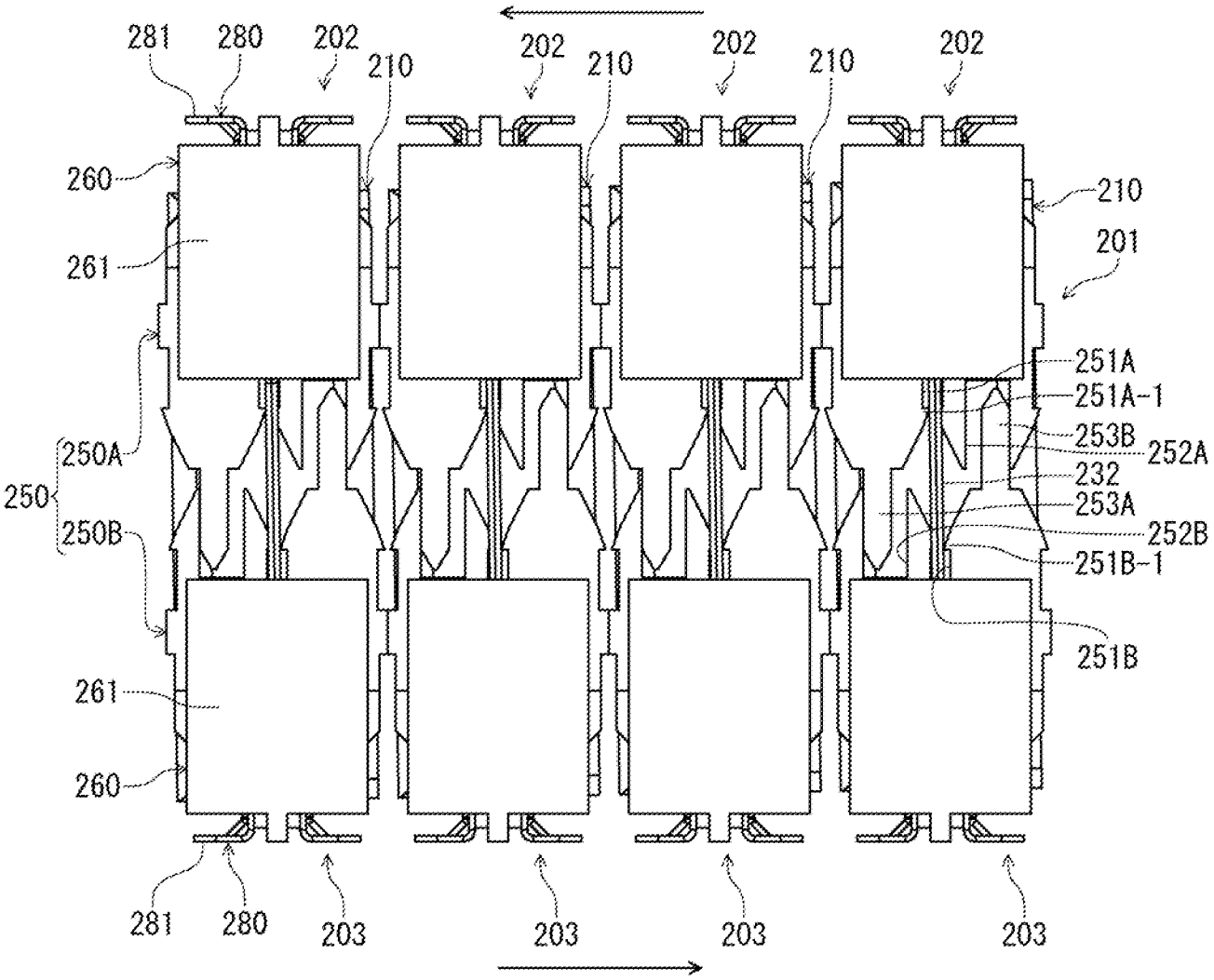
FIG. 23 is a side view showing the intermediate electrical connector and the mating connectors in their fitted state, wherein the intermediate electrical connector is in a state of floating in an arrangement direction of the intermediate connecting members.

Referring to FIG. 23, floating operation will be described, when there is displacement occurs between the mating connectors 202 and 203 in the arrangement direction (left-and-right direction in FIG. 23) of the intermediate connecting members 210. According to the second embodiment, a case will be described when unexpected external force is applied to the mating connectors 202 and 203 while the connectors are fitted, and the external force is applied in directions that are opposite to each other in the arrangement direction. In the example of FIG. 23, the displacement occurs by rightward movement of the mating connectors 203 and leftward movement of the mating connectors 202 relative to each other (See the respective arrows in FIG. 23).

When displacement occurs between the mating connectors 202 and 203 in the arrangement direction, flat supported portions 232 of the intermediate connecting members 210 tilt around the support protruding portions 251A-1 and 251B-1 in the range of the gaps from the support groove portions 251A and 251B of the supporting members. As a result, the intermediate connecting members 210 tilt, following the displacement. At this time, the intermediate connecting members 210 tilt while keeping the state that the support protruding portions 251A-1 and 251B-1 stably support the flat sections 232.

In addition, as shown in FIG. 23, in the support members 250, the outer edges (left edges) of the restricting protruding portions 253A of the upper members 250A abut the inner edges (left edges) of the regulating recessed portions of the lower members 250B. The outer edges (right edges) of the regulating protruding portions 253B of the lower members 250B abut the inner edges (right edges) of the regulating recessed portions 252A. With this operation, it is possible to restrict the relative movements above specified amount.

As described above, according to the second embodiment, the support members 250 are split into the upper members 250A and the lower members 250B in the up-and-down direction. The upper members 250A and the lower members 250B are capable of moving relative to each other within specified range in the arrangement direction of the intermediate connecting members 210.

Therefore, in comparison with a case of supporting the intermediate connecting members 210 with supporting members made of one member, it is possible to secure in the arrangement direction larger space to allow the tilting of the flat supported portions 232 of the intermediate connecting members 210 in the support groove portions 251A and 251B for the amounts of relative movements of the upper members 250A and the lower members 250B. As a result, the intermediate connecting members 210 can tilt at large angles, and thereby can follow large displacements in the arrangement direction. Therefore, it is possible to securely keep the electrical connection state among the connectors.

Moreover, the regulating recessed portions 252A and the regulating protruding portions 253A of the upper members 250A and the regulating protruding portions 253B and the regulating recessed portions 252B of the lower members 250B are disposed using the range that overlap each other in the up-and-down direction. Therefore, even when the dimensions of the regulating recessed portions 252A and 252B and the regulating protruding portions 253A and 253B are increased in the up-and-down direction, the sizes of the support members 250 and in turn the relay connector 201 will not be large in the up-and-down direction.

Moreover, increasing the dimensions of the regulating recessed portions 252A and 252B and the regulating protruding portions 253A and 253B in the up-and-down direction, the areas to abut each other (area of the end edges extending in the up-and-down direction) increase, so that it is possible to secure sufficient strength.

According to the second embodiment, the plurality of mating connectors 202 and 203 are disposed at constant intervals being close to each other. Correspondingly, the plurality of connecting bodies 210 are also arranged at constant intervals being close to each other in the arrangement direction of the intermediate connecting members 210 and is supported by the supporting members 210. However, according to the relay connector 201 of the second embodiment, even when the plurality of mating connectors 202 and 203 are arranged at even larger intervals, it is still manageable by supporting the flat supported portions 232 of the intermediate connecting members 210 with the support groove portions 251A and 251B corresponding to the relative positions between the mating connectors 202 and between the mating connectors 203.

In addition, according to the second embodiment, in the arrangement direction of the intermediate connecting members 210, the interval between the support groove portions 251 of the support members 250 is set as almost a half of the thickness of the intermediate connecting member 201, i.e., smaller than the thickness. Therefore, in comparison with when the interval is set as the same as the thickness direction, it is possible to more finely set the positions to dispose the intermediate connecting members 210 in the arrangement direction, and thereby it is possible to enhance the flexibility in the arrangement. Needless to say, when the support groove portions 251 in the support members 250 are formed with even smaller intervals between the adjacent support groove portions 251, it is possible to further enhance the flexibility of the arrangement of the intermediate connecting members 210.

According to the second embodiment, the supporting members are made of a sheet metal piece. However, the material of the supporting members is not limited to this. For example, the support members 250 may be made of resin. Moreover, the upper members 250A and the lower members 250B of the support members 250 have the same shape. However, as long as the regulating recessed portions 252A and 252B and the regulating protruding portions 253A and 253B are formed at the same positions in the arrangement direction of the intermediate connecting members 210, and the support members 250 are formed at the same positions, the upper members 250A and the lower members 250B can have different shapes.

In addition, the regulating recessed portions 252A and 252B and the regulating protruding portions 253A and 253B are formed on the both of the upper members 250A and the lower members 250B. However, alternatively, it is also possible to form the regulating recessed portions 252 only on the upper members 250A or the lower members 250B, and form the regulating protruding portions 253 only on the other, the lower members 250B or the upper members 250A.

According to the second embodiment, the flat sections of the intermediate connecting members 210 have the holes. When the flat supported portions 232 are housed in the support groove portions 251 of the support members 250, the support protruding portions 251-1 of the support groove portions 251 enter the holes. However, when it is possible to fully prevent coming off of the intermediate connecting members 210 from the support members 250, it is not form the holes. When the flat supported portions 232 do not have the holes, the flat supported portions 232 of the intermediate connecting members 210 are supported having their sheet surfaces clamped by the support protruding portions 251-1 of the supporting members 250. Moreover, similarly to the flat supported portions 232, it is not essential to provide the holes on the flat fitting sections 282 of the mating grounding plates 280 of the mating connectors 202.

Furthermore, according to the second embodiment, each flat supported portion 232 is formed as a part of the grounding plate 230. However, it is also possible to form the flat supported portions 232 on a member other than the grounding plates 230. For example, it is possible to form the flat supported portions as a part of substrates of the blades so as to be flat sections protruding from side end surfaces of the substrate.

According to the second embodiment, the mating connectors are two mating connecting bodies 202 and 203. Alternatively, it is also possible to have a circuit board as one or both of the mating connecting bodies. In this case, the terminals of the intermediate connecting members 210 have the connecting sections, which are to be connected to the circuit board by soldering, at their ends that are to be connected to the circuit board.

According to the second embodiment, each of the intermediate connecting members 210 is composed of two blades 210A and 210B. However, the number of the blades in each intermediate connecting member 210 is not limited to this. For example, it is also possible to compose each connecting body to have one blade. In this case, each mating connector has only mating terminals and mating grounding plate corresponding to the one blade.

The disclosure of Japanese Patent Applications No. 2013-192128, filed on Sep. 17, 2013, is incorporated in the application by reference.

While the present invention has been explained with reference to the specific embodiments of the present invention, the explanation is illustrative and the present invention is limited only by the appended claims.

What is claimed is:

1. An intermediate electrical connector to be connected to a mating connecting member, comprising:

an intermediate connecting member;

a blade disposed in the intermediate connecting member; and a supporting member for supporting the intermediate connecting member, wherein said intermediate connecting member includes a supported portion disposed on a side surface portion thereof and supported on the supporting member, said supporting member is formed of a plate member facing the side surface portion of the intermediate connecting member, and said supporting member includes a supporting portion accommodated in the supported portion or receiving the supported portion with a space in between.

2. The intermediate electrical connector according to claim 1, wherein said intermediate connecting member further includes a blade holding member for holding the blade, said supporting portion further includes an upper supporting portion and a lower supporting portion, and said supported portion includes an upper supported portion supported on the upper supporting portion and a lower supported portion supported on the lower supporting portion.

3. The intermediate electrical connector according to claim 1, wherein said intermediate connecting member further includes a protruding portion protruding outwardly so that protruding portion pushes the supporting member against the supported portion.

4. The intermediate electrical connector according to claim 1, wherein said supported portion is formed to protrude outwardly, said supporting member further includes a groove portion portion formed in a slit shape and a supporting protruding portion disposed in the groove portion portion.

5. The intermediate electrical connector according to claim 1, further comprising a ground plate attached to the board, wherein said supported portion is disposed on the ground plate.

6. The intermediate electrical connector according to claim 1, wherein said supporting member further includes an upper supporting member and a lower supporting member to be movable relative to the upper supporting member, and said supporting portion is disposed on each of the upper supporting member and the lower supporting member.

7. The intermediate electrical connector according to claim 4, wherein said upper supporting member and said lower supporting member are arranged so that edge portions thereof fit together, one of said upper supporting member and said lower supporting member includes a regulating recessed portion, and the other of said upper supporting member and said lower supporting member includes a regulating protruding portion fitting into the regulating recess portion so that an outer edge portion of the regulating protruding portion abuts against an inner edge portion of the regulating recessed portion.

8. The intermediate electrical connector according to claim 7, wherein said supporting member is formed of a metal plate having a flat surface, said upper supporting member is formed in a shape similar to that of the lower supporting member, and said regulating recessed portion and said regulating protruding portion are arranged in a repeated pattern.

* * * * *